US011311874B2

(12) United States Patent
Bandara et al.

(10) Patent No.: US 11,311,874 B2
(45) Date of Patent: Apr. 26, 2022

(54) POLYMER-BASED WELL PLATE DEVICES AND FLUIDIC SYSTEMS AND METHODS OF MAKING AND USING THE SAME

(71) Applicant: Oregon State University, Corvallis, OR (US)

(72) Inventors: Gayan C. Bandara, Corvallis, OR (US); Christopher A. Heist, Corvallis, OR (US); Sumate Pengpumkiat, Bangkok (TH); Vincent T. Remcho, Corvallis, OR (US)

(73) Assignee: Oregon Slate University, Corvallis, OR (US)

( * ) Notice: Subject to any disclaimer, the term of this patent is extended or adjusted under 35 U.S.C. 154(b) by 793 days.

(21) Appl. No.: 16/001,854

(22) Filed: Jun. 6, 2018

(65) Prior Publication Data

US 2018/0353956 A1 Dec. 13, 2018

Related U.S. Application Data

(60) Provisional application No. 62/516,620, filed on Jun. 7, 2017.

(51) Int. Cl.
*B01L 3/00* (2006.01)
*B01L 9/00* (2006.01)

(52) U.S. Cl.
CPC ..... *B01L 3/502707* (2013.01); *B01L 3/5085* (2013.01); *B01L 9/527* (2013.01);
(Continued)

(58) Field of Classification Search
CPC ..... B01L 3/5088; B01L 2300/126; B01L 2300/161; B01L 5/5085; B01L 5/502707;
(Continued)

(56) References Cited

U.S. PATENT DOCUMENTS 3,730,807 A 5/1973 Smith et al.
8,628,729 B2 1/2014 Carrilho et al.
(Continued)

FOREIGN PATENT DOCUMENTS

CN 105548315 A 5/2016
WO WO 2011/072715 6/2011
(Continued)

OTHER PUBLICATIONS

"Paper Microzone Plates," NIH 3D Print Exchange: A collection of biomedical 3D printable files and 3D printing resources supported by the National Institutes of Health, accessed at https://3dprint.nih.gov/discover/paper-microzone, Jul. 2014.
(Continued)

*Primary Examiner* — Jill A Warden
*Assistant Examiner* — Dwayne K Handy
(74) *Attorney, Agent, or Firm* — Klarquist Sparkman, LLP

(57) ABSTRACT

Embodiments of substrate-based devices disclosed herein comprise a polymeric substrate with a hydrophobic polymer coating that defines wells or openings on the polymeric substrate and/or serves as an adhesive agent between stacked substrates of the device. Also disclosed herein are embodiments of plate frames that can be used to align and hold well plate devices described herein. Methods of fabricating the disclosed devices also are described.

13 Claims, 22 Drawing Sheets

(52) U.S. Cl.
CPC ..... *B01L 9/52* (2013.01); *B01L 2200/12* (2013.01); *B01L 2300/0627* (2013.01); *B01L 2300/0829* (2013.01); *B01L 2300/0887* (2013.01); *B01L 2300/0893* (2013.01); *B01L 2300/123* (2013.01); *B01L 2300/126* (2013.01); *B01L 2300/165* (2013.01)

(58) Field of Classification Search
CPC ..... B01L 5/502753; B01L 2300/0887; B01L 2300/0893
See application file for complete search history.

(56) References Cited

U.S. PATENT DOCUMENTS

| | | | | |
|---|---|---|---|---|
| 2003/0039591 | A1* | 2/2003 | Pham | B01L 3/50855 422/561 |
| 2003/0102080 | A1 | 6/2003 | Mallik | |
| 2003/0220700 | A1 | 11/2003 | Hammer et al. | |
| 2004/0037990 | A1 | 2/2004 | Abe et al. | |
| 2008/0099064 | A1 | 5/2008 | Hayes | |
| 2009/0181411 | A1 | 7/2009 | Battrell et al. | |
| 2011/0107168 | A1 | 5/2011 | Jung et al. | |
| 2011/0123398 | A1* | 5/2011 | Carrilho | F16K 99/0015 422/68.1 |
| 2011/0272644 | A1 | 11/2011 | Remcho et al. | |
| 2013/0064713 | A1 | 3/2013 | Koesdjojo et al. | |
| 2013/0146643 | A1 | 6/2013 | Schmid et al. | |
| 2014/0106139 | A1 | 4/2014 | Abrams | |
| 2014/0248471 | A1 | 9/2014 | Hanschen et al. | |
| 2019/0091688 | A1 | 3/2019 | Bandara et al. | |
| 2019/0242870 | A1 | 8/2019 | Doi et al. | |

FOREIGN PATENT DOCUMENTS

| | | |
|---|---|---|
| WO | WO 2011/097677 | 8/2011 |
| WO | WO 2016/172675 | 10/2016 |
| WO | WO 2016/209147 | 12/2016 |
| WO | WO 2017/210199 | 12/2017 |

OTHER PUBLICATIONS

Abgrall et al., "Fabrication of planar nanofluidic channels in a thermoplastic by hot-embossing and thermal bonding," *Lab Chip*, No. 4, pp. 520-522, Jan. 11, 2007.
Allo et al., "Synthesis and Electrospinning of ε-Polycapralactone-Bioactive Glass Hybrid Biomaterials via a Sol-Gel Process," *Langmuir*, 26(23): 18340-18348, Nov. 4, 2010.
Armani et al., "Microfabrication technology for polycaprolactone, a biodegradable polymer," *J. Micromech. Microeng.*, 10(1): 80-84, Jan. 6, 2000.
Becker et al., "Hot embossing as a method for the fabrication of polymer high aspect ratio structures," *Sensors and Actuators*, 83(1-3): 130-135, May 22, 2000.
Burgoyne, "Interfacing of microfluidic devices." *Chips and Tips*, Feb. 27, 2009. rsc.org, blog, downloaded Jun. 27, 2013.
Carrilho et al., "Paper Microzone Plates," *Anal. Chem.*, 81(15): 5990-5998, Jul. 2, 2009.
Chen et al., "Fabrication, modification, and application of poly(methyl methacrylate) microfluidic chips," *Electrophoresis*, 29(9): 1801-1814, May 9, 2008.
Chen et al., "Vacuum-assisted thermal bonding of plastic capillary electrophoresis microchip imprinted with stainless steel template," *Journal of Chromatography A*, 1038(1-2): 239-245, Jun. 4, 2004.
Cheow et al., "Antibacterial Efficacy of Inhalable Antibiotic-Encapsulated Biodegradable Polymeric Nanoparticles Against *E. coli* Biofilm Cells," *Journal of Biomedical Nanotechnology*, 6(4): 391-403, Aug. 2010.
Christensen et al., "Characterization of interconnects used in PDMS microfluidic systems," *Journal of Micromechanics and Microengineering*, 15(5): 928-934, Mar. 22, 2005.
Chu et al., "Comparison of polyurethane foam and biodegradable polymer as carriers in moving bed biofilm reactor for treating wastewater with a low C/N ratio," *Chemosphere*, 83(1): 63-68, Mar. 2011.
Dang et al., "Replica mutilchannel polymer chips with a network of sacrificial channels sealed by adhesive printing method," *Lab Chip*, vol. 4, pp. 472-478, Feb. 1, 2005.
Davis et al., "Carrier systems and biosensors for biomedical applications," *Tissue Engineering Using Ceramics and Polymers: Second Edition*, pp. 270-302, 2014.
Esch et al., "Influence of master fabrication techniques on the characteristics of embossed microfluidic channels," *Lab Chip*, vol. 3, pp. 121-127, May 2, 2003.
Hu et al., "The use of reactive polymer coatings to facilitate gene delivery from poly (ε-caprolactone) scaffolds," *Biomaterials*, 30(29): 5785-5792, Oct. 2009.
Ishida et al., "Reversed-phase liquid chromatography on a microchip with sample injector and monolithic silica column," *Journal of Chromatography A*, 1132(1-2): 90-98, Nov. 3, 2006.
Jacobson et al., "Effects of Injection Schemes and Column Geometry on the Performance of Microchip Electrophoresis Devices," *Anal. Chem.*, 66(7): 1107-1113, Apr. 1994.
Jain et al., "Performance of an Optimized Paper-Based Test for Rapid Visual Measurement of Alanine Aminotransferase (ALT) in Fingerstick and Venipuncture Samples," *PLOS ONE*, 10(5): 1-15, May 28, 2015.
Kaigala et al., "Rapid prototyping of microfluidic devices with a wax printer," *Lab Chip*, vol. 7, pp. 384-387, Jan. 10, 2007.
Kelly et al., "Thermal Bonding of Polymeric Capillary Electrophoresis Microdevices in Water," *Anal. Chem.*, 75(8): 1941-1945, Apr. 15, 2003.
Khang et al., "Room-temperature imprint lithography by solvent vapor treatment," *Applied Physics Letters*, 76(7): 870-871, Feb. 4, 2000.
Kho et al., "Aqueous re-dispersibility of spray-dried antibiotic-loaded polycaprolactone nanoparticle aggregates for inhaled antibiofilm therapy," *Powder Technology*, 203(3): 432-439, Nov. 25, 2010.
Koesdjojo et al., "Fabrication of a Microfluidic System for Capillary Electrophoresis Using a Two-Stage Embossing Technique and Solvent Welding on Poly(methyl methacrylate) with Water as a Sacrificial Layer," *Anal. Chem.*, 80(7): 2311-2318, Apr. 1, 2008.
Koesdjojo et al., "Two-stage polymer embossing of co-planar microfluidic features for microfluidic devices," *Sensors and Actuators B*, 131(2): 692-697, May 14, 2008.
Kundu et al., "Continuous Flow Enzyme-Catalyzed Polymerization in a Microreactor," *JACS*, 133(15): 6006-6011, Mar. 25, 2011.
Lai et al., "A Packaging Technique for Polymer Microfluidic Platforms," *Anal. Chem.*, 76(4): 1175-1183, Feb. 15, 2004.
Lee et al., "Microfabricated plastic chips by hot embossing methods and their applications for DNA separation and detection," *Sensors and Actuators B*, vol. 75, pp. 142-148, 2001.
Lei et al., "Microwave bonding of polymer-based substrates for potential encapsulated micro/nanofluidic device fabrication," *Sensors and Actuators A*, 114(2-3): 340-346, Feb. 28, 2004.
Li et al., "Polydimethylsioxane Fluidic Interconnects for Microfluidic Systems," *IEEE Transactions on Advanced Packaging*, 26(3): 242-247, Aug. 2003.
Licata et al., "How to bond polycarbonate parts by solvent welding," *Plastics Engineering*, 42(6): 53-55, Jun. 1986.
Lim et al., "Micropatterning and Characterization of Electrospun Poly(ε-Caprolactone)/Gelatin Nanofiber Tissue Scaffolds by Femtosecond Laser Ablation for Tissue Engineering Applications," *Biotechnology and Bioengineering*, 108(1): 116-126, Jan. 1, 2011.
Lin et al., "Low azeotropic solvent for bonding of PMMA microfluidic devices," *Sensors and Actuators B*, 121 (2): 698-705, Jun. 2, 2006.
Liu et al., "Fabrication of Balloon-Expandable Self-Lock Drug-Eluting Polycaprolactone Stents Using Micro-Injection Molding and Spray Coating Techniques," Annals of Biomedical Engineering, 38(10): 3185-3194, May 22, 2010.
Machell et al., "Optical Properties of Solvent-Cast Polymer Films," *Macromolecules*, 23(1): 186-194, 1990.

(56) References Cited

OTHER PUBLICATIONS

Manz et al., "Micromachining of monocrystalline silicon and glass for chemical analysis systems: A look into next century's technology or just a fashionable craze?," *Trends in Analytical Chemistry*, 10(5): 144-149, 1991.
Martinez et al., "Diagnostics for the Developing World: Microfluidic Paper-Based Analytical Devices," *Anal. Chem.*, 82(1): 3-10, Jan. 1, 2010.
McDonald et al., "Fabrication of microfluidic systems in poly(dimethylsiloxane)," *Electrophoresis*, 21 (1): 27-40, Jan. 1, 2000.
Muck, Jr. et al., "Fabrication of Poly(methyl methacrylate) Microfluidic Chips by Atmospheric Molding," *Anal. Chem.*, 76(8): 2290-2297, Feb. 28, 2004.
Peeni et al., "Sacrificial layer microfluidic device fabrication methods," *Electrophoresis*, 27(24): 4888-4895, Dec. 2006.
Pengpumkiat et al., "A Paper-Based Disposable Well-Plate for Cyanide Detection Incorporating a Fluorescent Chitosan-CdTe Quantum Dot Nanoparticle," Poster Presentation at PITTCON Conference and Expo 2017, Chicago, Mar. 2017.
Pengpumkiat et al., "A Paper-Based Disposable Well-Plate for Cyanide Detection Incorporating a Fluorescent Chitosan-CdTe Quantum Dot Nanoparticle," Abstract, PITTCON Conference and Expo 2017, Chicago, Mar. 2017.
Rella et al., "Rapid Cyanide Detection Using the Cyantesmo® Kit," *Journal of Toxicology, Clinical Toxicology*, 42(6): 897-900, 2004.
Roberts et al., "UV-Laser Machined Polymer Substrates for the Development of Micro-Diagnostic Systems," *Anal. Chem.*, 69(11): 2035-2042, Jun. 1, 1997.
Rossier et al., "Electrochemical Detection in Polymer Microchannels," *Anal. Chem.*, 71(19): 4294-4299, Oct. 1, 1999.
Rossier et al., "Electrophoresis with electrochemical detection in a polymer microdevice," *Journal of Electroanalytical Chemistry*, 492(1): 15-22, Sep. 29, 2000.
Rossier et al., "Topography, Crystallinity and Wettability of Photoablated PET Surfaces," *Langmuir*, 15(15): 5173-5178, Jun. 25, 1999.
Rundel et al., "Organic solvent nanofiltration for microfluidic purification of poly(amidoamine) dendrimers," *Journal of Chromatography A*, 1162(2): 167-174, Aug. 31, 2007.
Santiago et al., "Peptide-surface modification of poly(caprolactone) with laminin-derived sequences for adipose-derived stem cell applications," *Biomaterials*, 27(15): 2962-2969, Jan. 30, 2006.
Sarasam et al., "Characterization of chitosan-polycapralactone blends for tissue engineering applications," *Biomaterials*, 26(27): 5500-5508, Apr. 7, 2005.
Shah et al., "Capillarity Induced Solvent-Actuated Bonding of Polymeric Microfluidic Device," *Anal. Chem.*, 78(10): 3348-3353, Apr. 12, 2006.
Skotak et al., "Letter to the Editor," *Carbohydrate Polymers*, vol. 5, 1-3, Nov. 5, 2010.
Sousa et al., "Selective Protein Adsorption on a Phase-Separated Solvent-Cast Polymer Blend," *Langmuir*, 22(14): 6286-6292, May 28, 2006.
Sun et al., "Rapid Prototyping of Poly(methyl methacrylate) Microfluidic Systems Using Solvent Imprinting and Bonding," *J. Chromatogr. A*, 1162(2): 162-166, Aug. 31, 2007.
Wang et al., "Towards disposable lab-on-a-chip: Poly(methylmethacrylate) microchip electrophoresis device with electrochemical detection," *Electrophoresis*, 23(4): 596-601, Feb. 4, 2002.
Woodruff et al., "The return of a forgotten polymer-Polycaprolactone in the 21st century," *Progress in Polymer Science*, 35(10): 1217-1256, Apr. 7, 2010.
Xie et al., "Gas sensor arrays based on polymer-carbon black to detect organic vapors at low concentration," *Sensors and Actuators B*, 113(2): 887-891, Aug. 24, 2005.
Yang et al., "Microfluidic assisted synthesis of multi-functional polycaprolactone microcapsules: incorporation of CdTe quantum dots, $Fe_3O_4$ superparamagnetic nanoparticles and tamoxifen anticancer drugs," *Lab Chip*, No. 7, pp. 961-965, Dec. 19, 2008.
Ye et al., "DNA separation with low-viscosity sieving matrix on microfabricated polycarbonate microfluidic chips," *Anal. Bioanal. Chem.*, 381(4): 820-827, Jan. 19, 2005.
Yeo et al., "Ultrafast microfluidics using surface acoustic waves," *Biomicrofluidics*, 3(1): 012002-1-012002-23, Jan. 2, 2009.
Ying et al., "Starch/Polycaprolactone Blends Compatibilized with Starch Modified Polyurethane," *Chem. Res. Chinese Universities*, 26(3): 483-487, 2010.
Yokoyama et al., "Detection and Evaluation of Fragrances by Human Reactions Using a Chemical Sensor Based on Adsorbate Detection," *Anal. Chem.*, 65(6): 673-677, Mar. 15, 1993.
Zhang et al., "A paper-based platform for detection of viral RNA," *Analyst.*, 142(5): 815-823, Feb. 27, 2017.
Zhao et al., "Facile preparation of fluorescence-encoded microspheres based on microfluidic system," *Journal of Colloid and Interface Science*, 352(2): 337-342, Dec. 15, 2010.
Zheng et al., "An amperometric biosensor based on hemoglobin immobilized in poly(ε-caprolactone) film and its application," *Biosensors and Bioelectronics*, vol. 23, pp. 1562-1566, Jan. 12, 2008.
Zhou et al., "Poly(ε-caprolactone) as substrate for water denitrification," *Int. J. Environment and Pollution*, 38(3): 349-359, 2009.
Zhu et al., "Surface Modification of Polycaprolactone Membrane via Aminolysis and Biomacromolecule Immobilization for Promoting Cytocompatibility of Human Endothelial Cells," *Biomacromolecules*, 3(6): 1312-1319, Sep. 18, 2002.
Jayawardane et al., "The use of a polymer inclusion membrane in a paper-based sensor for the selective determination of Cu(II)," *Analytica Chimica Acta*, vol. 803, pp. 106-112, Jul. 16, 2013.
Spicar-Mihalic et al., "$CO_2$ laser cutting and ablative etching for the fabrication of paper-based devices," J. Micromech. Microeng. 23 (May 13, 2013), 6 pages.
Nie et al. "One-step patterning of hollow microstructures in paper by laser cutting to create microfluidic analytical devices," Analyst, Nov. 14, 2012, 138, 671.
Lewis et al., "Quantifying analytes in paper-based microfluidic devices without using external electronic readers," *Angew. Chem. Int. Ed.*, 51(51): 12707-12710, Nov. 9, 2012.
Zhang et al., "Naked-eye quantitative aptamer-based assay on paper device," *Biosensors and Bioelectronics*, vol. 78, pp. 538-546, Dec. 4, 2015.

* cited by examiner

POLYMER-BASED WELL PLATE DEVICES AND FLUIDIC SYSTEMS AND METHODS OF MAKING AND USING THE SAME

CROSS REFERENCE TO RELATED APPLICATIONS

This application claims the benefit of U.S. Provisional Patent Application No. 62/516,620, filed Jun. 7, 2017, which is incorporated herein by reference in its entirety.

FIELD

The present disclosure concerns polymer-based devices and microfluidic systems useful for diagnostic and analytical methods and methods of making and using the same.

BACKGROUND

Microfluidic paper-based analytical devices (μPADS) have increased in popularity as a means of decreasing the cost of common clinical chemistry assays and making these tests available to the developing world since the mid 2000's. There is currently no standard means of developing/modifying the assay chemistry, or detecting the resulting output (colorimetric or fluorescence) of such devices. Similarly, there is a large segment of the developed world that can make use of a low-cost alternative to expensive well plates and manual processes for adding reagents commonly used for laboratory based assays. Thus, a need in the art exists for devices, and methods for fabricating such devices, that provide a low-cost alternative to conventional expensive devices used for diagnostic and/or analytical techniques.

SUMMARY

Disclosed herein are embodiments of a polymer-based analytical device. In some embodiments, the device comprises a substrate comprising a coating of a hydrophobic polymer component wherein the coating of the hydrophobic polymer is configured to define outer perimeters of wells on or openings in the substrate and wherein the hydrophobic polymer component has a structure satisfying Formula I Formula I

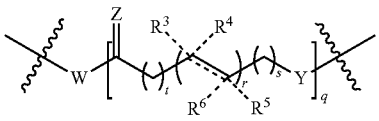

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

In yet additional embodiments, the devices can comprise a bottom substrate comprising a coating of a hydrophobic polymer component; an intermediate substrate coupled to the bottom substrate, the intermediate substrate comprising a coating of a hydrophobic polymer component that defines outer perimeters of wells on or openings in the intermediate substrate; a sensor substrate coupled to the intermediate substrate, the sensor substrate comprising a signaling moiety or a sample; and a top substrate coupled to the sensor substrate, the top substrate comprising a coating of a hydrophobic polymer component that defines outer perimeters of wells or openings having a pattern matching a pattern of the wells or openings of the intermediate substrate; wherein the hydrophobic polymer component has a structure satisfying Formula I:

Formula I

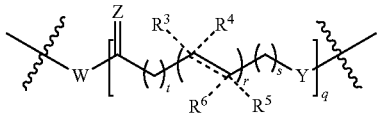

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

Also disclosed herein are embodiments of methods of making polymer-based analytical devices. In some embodiments, the methods can comprise masking a substrate made of a polymeric material with a masking material to form a masked substrate; patterning the masked substrate by cutting a pre-determined pattern into the masking material thereby providing hydrophilic unmasked areas of the masked substrate and masked areas of the masked substrate; coating the hydrophilic unmasked areas of the substrate with a hydrophobic polymer layer thereby converting the hydrophilic unmasked areas of the masked substrate to hydrophobic unmasked areas; and removing any remaining masking material from the masked substrate to expose one or more wells or openings, each of which has an outer perimeter defined by the hydrophobic polymer layer of the substrate and wherein the wells or openings are configured in the pre-determined pattern.

In yet additional embodiments, the methods can comprise exposing a polymeric substrate to a solution of a hydrophobic polymer component to form a layer of the hydrophobic polymer component that fully covers the polymeric substrate thereby forming a fully-coated polymeric substrate; patterning the fully-coated polymeric substrate to comprise a plurality of wells or openings thereby forming a patterned polymeric substrate, wherein each well or opening of the plurality of wells or openings has an outer perimeter defined by the hydrophobic polymer; exposing the patterned polymeric substrate to $O_2$ to render the hydrophobic polymer located in the wells or openings; and coupling the patterned polymeric substrate with a hydrophobic polymer-coated bottom substrate.

Also disclosed herein are embodiments of a plate frame. In some embodiments, the plate frame can comprise a first component made of a polymeric material, such as a biodegradable polymer, and having an outer perimeter section; a second component made of a polymeric material, such as a biodegradable polymer, and having an outer perimeter section configured to align with the outer perimeter section of the first component; one or more magnets positioned within the outer perimeter section of the second component; and one or more magnets positioned within the outer perimeter section of the first component, which magnets of the first component are positioned to align with the magnets of the second component and secure the first component to the second component in a predetermined alignment by magnetic attraction; wherein when the first component and the second component are associated together, they define a chamber that is configured to receive a polymer-based analytical device as described herein between the second component and the first component.

The foregoing and other objects, features, and advantages of the present disclosure will become more apparent from the following detailed description, which proceeds with reference to the accompanying figures.

BRIEF DESCRIPTION OF THE DRAWINGS

FIGS. 14A-14C are illustrations of a representative device embodiment described herein, wherein FIG. 14A illustrates an intermediate substrate comprising three rows of wells connected via fluidic channels; FIG. 14B illustrates an embodiment wherein the intermediate substrate of FIG. 14A has been coupled with a top substrate that facilitates visualization of the wells of the intermediate substrate; and FIG. 14C illustrates an embodiment wherein the intermediate substrate of FIG. 14A has been coupled with a top substrate that facilitates visualization of the wells and fluidic channels of the intermediate substrate.

FIG. 15A shows an intermediate substrate after deposition of a red dye into a well of the intermediate substrate; FIG. 15B shows an intermediate substrate coupled with a top substrate that allows visualization of the wells of the intermediate substrate and wherein it can be seen that fluid flow through the wells and fluidic channels of the device allows the blue dye shown in the well of column b, row 2 to be transferred to the well of column c, row 3 by red dye introduced into the well of column a, row 3.

FIGS. 16A and 16B illustrate another representative device comprising a plurality of stacked substrates, wherein FIG. 16A illustrates a top plan view of the fully constructed device and FIG. 16B illustrates an exploded top view of the device of FIG. 16A, and shows the different substrates that make-up the device.

FIG. 18A shows emission spectra of CS-QD520 compared to the original QD520 (where the inset shows image "a," which is CS-QD520 under UV light at 365 nm and image "b," which is QD520 under UV light 365 nm; FIG. 18B is a TEM image of CS-QD520; and FIG. 18C is a ChemiSTEM mode image of the same area of FIG. 18B showing elemental analysis.

FIG. 19A illustrates results before flushing with PB buffer 10 mM, pH 7; and FIG. 19B shows results after flushing with PB buffer 10 mM, pH 7.

FIG. 20A illustrates results from a set of tested anions at 1 mM compared to cyanide at 100 μM; and FIG. 20B illustrates results from a set of tested cations at 1 mM compared to cyanide at 100 μM.

FIG. 22A shows the effect of CS-QD520 concentration [conditions: ratio of CSQD: $Cu^{2+}$ (100 mg/L)=4.085 μM: 25 μL, reaction time=30 min]; FIG. 22B shows the effect of amount of $Cu^{2+}$ (100 mg/L) for quenching a CS-QD520 probe [conditions: CSQD=8.17 μM, reaction time=30 min]; and FIG. 22C shows the effect of reaction time [conditions: CSQD=8.17 μM, $Cu^{2}$+, 100 mg/L=40 μL].

FIG. 26A shows the device and FIG. 26B shows the device when placed within a plate frame.

FIGS. 27A-7E are photographic images showing a representative low volume "dimple" plates comprising a polymer film (e.g., polyethyleneteraphthalate ["PET" ]) sprayed with a polymer component (e.g., PCL) to provide adhesion between laminated substrates; FIG. 7A is a top view of a constructed well plate device; FIG. 7E is a zoomed photographic image of the device.

DETAILED DESCRIPTION

I. Explanation of Terms

Figure 1:
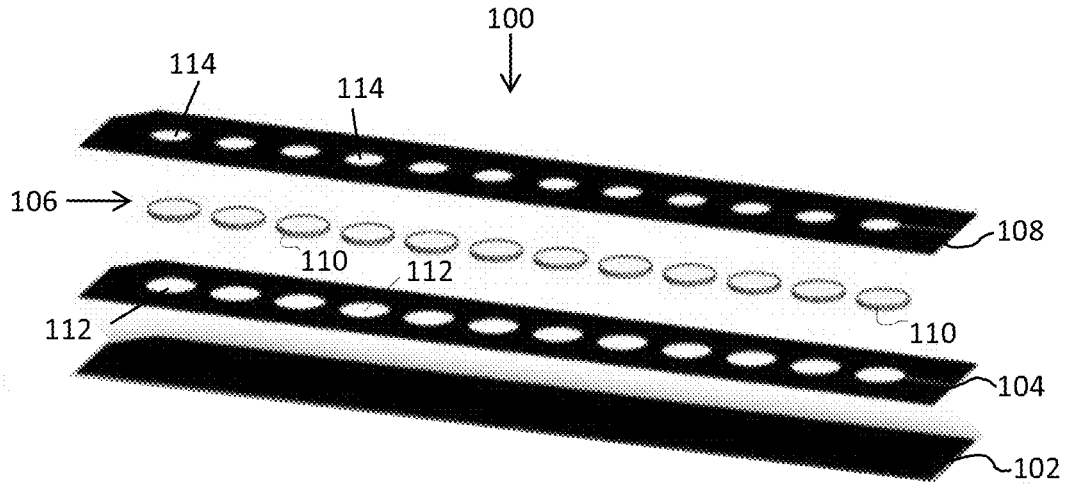
FIG. 1 is an exploded perspective view of a representative paper-based strip device.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Any theories of operation are to facilitate explanation, but the disclosed devices, materials, and methods are not limited to such theories of operation. Although the operations of some of the disclosed methods are described in a particular, sequential order for convenient presentation, it will be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed components and materials can be used in conjunction with other components and materials. Additionally, the description sometimes uses terms such as "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or devices are referred to as "lowest," "best," "minimum," or the like. It will be appreciated that such descriptions are intended to indicate that a selection among many used functional alternatives can be made, and such selections need not be better, smaller, or otherwise preferable to other selections.

Examples are described with reference to directions indicated as "above," "below," "upper," "lower," and the like. These terms are used for convenient description, but do not imply any particular spatial orientation.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

To facilitate review of the various embodiments of the disclosure, the following explanations of specific terms are provided:

Cellulosic Polymer: A polymer made of cellulose or a derivative thereof.

Elastomeric Polymer: A flexible polymer. Exemplary elastomeric polymers include, but are not limited to, unsaturated rubbers, such as polyisoprene or polybutadiene, and saturated rubbers, such as epichlorohydrin and ethylene-vinyl acetate.

Opening: An aperture or gap in the surface of a substrate that allows a fluid or solid to pass through the substrate and/or that serves to contain a fluid or solid within a perimeter of the opening. In some embodiments, openings are surrounded by a hydrophobic polymer component and thus the hydrophobic polymer defines the outer perimeter of the opening.

Sump: A region of a substrate used in certain device embodiments that is configured to accept a volume of a fluid, such as an aqueous solution, melted polymer and/or wax used as a valve in device embodiments described herein.

Synthetic Fiber Polymer: A polymer that is not found in nature, but mimics physical and/or chemical properties of a natural plant or animal fiber.

Thermoplastic Polymer: A type of polymer that becomes moldable and malleable above a particular temperature, and that solidifies upon cooling. Exemplary thermoplastic polymers include, but are not limited to, polyamides, polylactic acid, polycarbonate, polyetherimide, polypropylene, polystyrene, polyvinyl chloride, polytetrafluoroethylene, and the like.

Thermoset Polymer: A type of polymer that changes from a soft or viscous state into a hard polymer by curing and does not change shape after curing. Exemplary thermoset polymers include, but are not limited to, polyester resin, polyurethanes, epoxy resin, cyanate esters, and the like.

Well: A region of a substrate used in certain device embodiments described herein wherein the region is hydrophilic and thus capable of absorbing a fluid, such as a liquid. In some embodiments, a well is defined on the surface of a polymeric substrate by a hydrophobic polymer layer. In other embodiments, a well is defined as a region of a substrate that is hydrophilic and not filled with a hydrophobic flow barrier (polymer), which is surrounded by that same substrate which has been modified by deposition of a hydrophobic or less hydrophilic material such as a polymer.

II. Introduction

The substrate-based devices described herein are biodegradable, disposable devices that provide an inexpensive alternative to conventional expensive devices used in analytical and biochemical analysis, such as polymeric well plates (or micro-titer plates). In some embodiments, the disclosed devices include paper-based devices, such as analytical paper-based strips and/or paper-based well plates. The disclosed devices also can utilize a separate polymeric material (that is, a polymeric material that is separate from the polymer material of the substrates of the substrate-based devices) as a device component and as a bonding agent capable of adhering device substrates together.

The disclosed devices can be used to avoid multi-step assays as the devices provide a mechanism for combining different steps of a multi-step assay into a single step by incorporating a microfluidic architecture that connects multiple wells and/or openings of a well plate and/or stacking layers that can provide a plurality of reagents. This allows for reagents to be stored separately on a well plate, or to be added via robotic liquid handling (or even manually) thus eliminating or reducing washing steps necessary in traditional multi-step assays conducted in well plates. The devices also provide the possibility of including reagents in dried form into the disposable, low-cost well plate assay device. The devices disclosed herein can be integrated with components typically used for analytical analysis, such as plate readers, plate washers, plate stackers/handlers, and dispensing technologies.

III. Devices

Disclosed herein are embodiments of substrate-based analytical devices. In some embodiments, the devices are polymeric substrate-based analytical devices suitable for fluid handling in analytical techniques, such as analyte detection, qualification, or quantification, diagnostics, biological assays, and the like. The disclosed devices are substrate-based devices that comprise a patterned substrate made of a polymeric material and/or a fibrous material; or a plurality of stacked substrates, each made of a polymeric material and/or a fibrous material. In some embodiments, the polymeric material is a cellulosic polymer and the fibrous material is a glass fiber material. In some other embodiments, the polymeric material is a thermoplastic polymer, a thermoset polymer, an elastomeric polymer, a synthetic fiber polymer, or a combination thereof. In some embodiments, the fibrous material is a glass microfiber material. In particular disclosed embodiments, the substrates are made from a porous polymeric material, such as a material made with a cellulose (or cellulose derivative) pulp; or a polymeric material, such as polyethyleneteraphthalate (PET). In some embodiments, the substrates can be made using a material that is suitable for use in UV-Vis analysis or fluorescence analysis. Materials suitable for use in fluorescence analysis typically have a dark color (e.g., black) such that it does not fluoresce using fluorescent analytical techniques.

In particular disclosed embodiments, the disclosed substrate-based analytical devices include substrate-based strip devices and substrate-based well plate components (e.g., substrate-based well plates and well plate frames). The disclosed substrate-based analytical devices of the present disclosure utilize a biodegradable hydrophobic polymer to provide a hydrophobic barrier on certain substrates used for the substrate-based analytical device. In particular disclosed embodiments, the hydrophobic polymer is used to define wells of a substrate. For example, the substrate-based analytical devices can be paper-based devices that comprise paper strips patterned with a single row of wells used for strip-based devices, wherein the paper is coated with the hydrophobic polymer such that it defines the walls of the wells. In yet additional embodiments, the paper strips are patterned with a single row of openings wherein the outer perimeter of each opening is surrounded by the hydrophobic polymer. In additional embodiments, the hydrophobic polymer can be used to make substrates that can act as an adhesive to connect different layers of a device. In additional embodiments, the substrate-based analytical devices are paper-based well plate devices that comprise paper substrates patterned with a plurality of wells wherein the outer perimeter of each well is defined by the hydrophobic polymer. In yet some additional embodiments, the hydrophobic polymer can provide a hydrophobic barrier between openings of a substrate. Polymeric substrates also are contemplated wherein the strip is a strip of polymeric (e.g., PET) material or wherein the well plate substrates are polymeric (e.g., PET) substrates.

In particular disclosed embodiments, the substrate-based analytical devices comprise at least one patterned substrate and can further comprise one or more additional substrates that may or may not be patterned. Each substrate of the substrate-based analytical device can be modified with the hydrophobic polymer such that the polymer completely covers the substrate (e.g., the hydrophobic polymer covers from 95% to 100% of the surface area of one or all surfaces of the substrate) or partially covers the substrate (e.g., the hydrophobic polymer covers less than 100% of the surface area of one or all surfaces of the substrate, such as 1% to 95%, or 5% to 90%, or 10% to 80%). In yet additional embodiments, the polymer can cover the substrate only in areas defining wells and/or openings of the substrate such that the polymer is not located within the wells or the openings. In yet additional embodiments, the polymer does not cover openings of a substrate.

In particular disclosed embodiments, the substrate-based analytical device can comprise multiple substrates. For example, some embodiments comprise a base substrate that typically is a non-patterned substrate; one or more intermediate substrates that may or may not be patterned to comprise a plurality of wells and/or a plurality of openings; a top substrate that typically is, but need not be, a patterned substrate comprising a plurality of wells and/or a plurality of openings; and any combination thereof. In particular disclosed embodiments, the devices comprise a bottom substrate, an intermediate substrate, and a top substrate.

In particular disclosed embodiments, the top substrate is patterned with a plurality of wells and/or openings that are patterned in a configuration matching a pattern of wells and/or openings formed in an intermediate substrate. In yet additional embodiments, the wells and/or openings patterned in the top substrate can be configured to be smaller than the wells and/or openings patterned in the intermediate substrate. In yet additional embodiments, the top substrate does not need to be patterned to comprise wells or openings and instead can be used to protect an immobilized reagent from leaking from other substrates of the device and/or protect such reagents from degradation (e.g., photodegradation) and possible contamination or side reactions (e.g., oxidation). The wells and/or openings of both the top and intermediate substrates can have any shape, such as circular, rectangular, square, oval, or any other geometrical shape. In representative embodiments, the wells and/or openings of the top and intermediate substrates are circular. In some embodiments, the wells of the top and/or intermediate substrate (or even sensor substrates described herein) can be modified to comprise a surface-passivating agent, such as a blocking agent (e.g., bovine serum albumin, milk protein, or the like), or a silylating agent, such as trimethyl chlorosilane (TMCS), or other silicon-containing reagents. These surface-passivating agents can be used to preserve assay chemistry and or to enhance output signals produced when using the device.

The wells and/or openings of both the top and intermediate substrates also can be configured to have a particular size that can be selected to match the particular methods for which the substrate-based analytical device is to be used. In some embodiments, the wells and/or openings of the intermediate substrate are configured to have an area of 0.5 $mm^2$ to 20 $mm^2$, such as 2 $mm^2$ to 10 $mm^2$, or 2 $mm^2$ to 5 $mm^2$. In particular disclosed embodiments, the wells and/or openings of the intermediate substrate are circular and have a diameter of 2 mm to 35 mm, such as 6 mm to 30 mm, 11 to 22 mm. Representative embodiments comprise wells and/or openings in the intermediate substrate having a diameter of 2.7 mm, 6.4 mm, 6.8 mm, 11 mm, 15.6 mm, 22.1 mm, and 34.8 mm. In some embodiments, the wells and/or openings of the top substrate are configured to have an area of 1 $mm^2$ to 900 $mm^2$, such as 1 $mm^2$ to 876 $mm^2$, or 20 $mm^2$ to 340 $mm^2$. Representative embodiments comprise wells and/or openings having an area of 1.33 $mm^2$, 19.63 $mm^2$, 72.38 $mm^2$, 158.37 $mm^2$, 336.53 $mm^2$, and 878.16 $mm^2$. In particular disclosed embodiments, the wells and/or openings of the top substrate are circular and have a diameter of 1 mm to 34 mm, such as 1.3 mm to 33.4 mm, or 5 mm to 20 mm. Representative embodiments comprise wells and/or openings in the top substrate having a diameter of 1.3 mm, 5 mm, 5.4 mm, 9.6 mm, 14.20 mm, 20.7 mm, and 33.4 mm. In some embodiments, the shape and size of each well and/or opening of the intermediate and/or top substrates can be varied such that each well in a plurality of wells and/or openings can have different sizes and/or different shapes. Solely by way of example, some embodiments can utilize intermediate and/or top substrates that have gradually increasing or decreasing well and/or opening sizes, such that the wells and/or openings in a row of wells and/or openings increase in size from left to right (or vice versa).

In some embodiments, the substrate-based analytical devices can further comprise a sensor substrate. The sensor substrate can be used to provide the analyte to be evaluated using the substrate-based analytical device, or it can be used to provide one or more signaling agents that interact with an external sample comprising an analyte. The analyte or signaling agent can be provided with the sensor substrate in a constructed device ready for use or it can be added to the sensor substrate prior to use. In some embodiments, the sensor substrate can be positioned between the top paper substrate and the intermediate paper substrate. In some embodiments, the sensor substrate can comprise a substrate configured to include a plurality of wells onto which an analyte can be deposited. In some embodiments, the sensor substrate can be a sheet comprising textured areas arranged in a configuration that matches that of the wells and/or openings of the intermediate substrate to which it is coupled. In some embodiments, a glass fiber material can be used to provide the textured areas. In yet additional embodiments, the sensor substrate can be provided as a plurality of individual substrates upon which an analyte can be deposited, such as a plurality of individual glass microfiber substrates. The individual substrates typically are fabricated to have a shape and size matching that of the wells and/or openings of the intermediate substrate. In such embodiments, the individual substrates are aligned with the wells and/or openings of the intermediate substrate. The sensor substrate can comprise any material suitable for absorbing an analyte. Analytes can be provided neat or as a solution. In particular disclosed embodiments, the sensor substrate is made of a microfiber material, such as a glass microfiber material or a polymer-filled glass microfiber material; a cellulosic material, such as paper or nitrocellulose membranes; a fine woven material, such as nylon or other polymers; and natural materials, such as cotton or wool. In particular disclosed embodiments, the sensor substrate comprises a borosilicate glass material. In some embodiments, the particular choice of material can depend on assay conditions, such as reagent composition (e.g., solvent compatibility), and sample composition. Materials may be selected based on the detection mechanism. For example, with solid opaque materials, the ability to read through the material (such as in UV-VIS instruments, which use a top or bottom read with illumination from the opposite side) is reduced and can thereby decrease the observable signal. This can be avoided by selecting a particular material that improves readability of the signal. In some embodiments using fluorescence detection, illumination and detection occur from the same side and thus one can use a variety of materials so long as the background fluorescence is low enough to not interfere with the assay.

A representative strip-based device is illustrated in FIG. 1. As illustrated in FIG. 1, strip-based device 100 can comprise four different substrates, such as bottom substrate 102, intermediate substrate 104, sensor substrate 106, and top substrate 108. In the embodiment illustrated in FIG. 1, the sensor substrate comprises a plurality of individual sensor substrate substrates 110 that are fabricated to match the size, shape, and pattern of openings 112 of the intermediate substrate 104. Top substrate 108 comprises openings 114, which are fabricated to have a smaller diameter than that of the individual sensor substrate substrates 110. While a particular number of openings (e.g., 12 openings) and individual sensor substrate substrates (e.g., 12 openings) are depicted in FIG. 1, the present disclosure is not limited to this particular embodiment and contemplates other embodiments wherein more or fewer individual sensor substrate substrates and/or openings (or wells) are provided. Also, the shape and size of each well and/or opening of the intermediate substrate and the top substrate can vary as described above.

Figure 2:
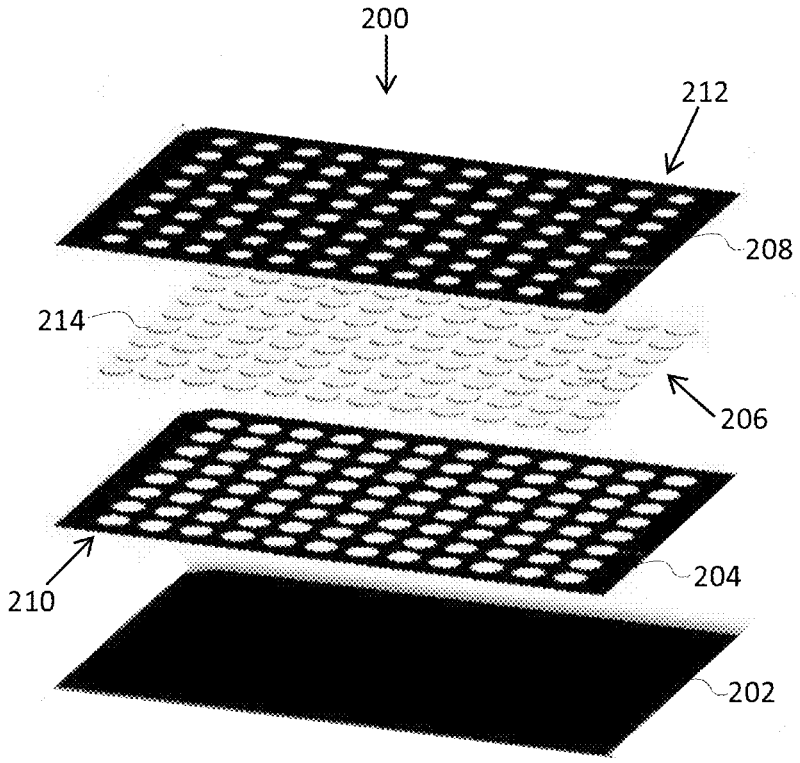
FIG. 2 is an exploded perspective view of a representative paper-based, 96-well plate device.
Figure 3:
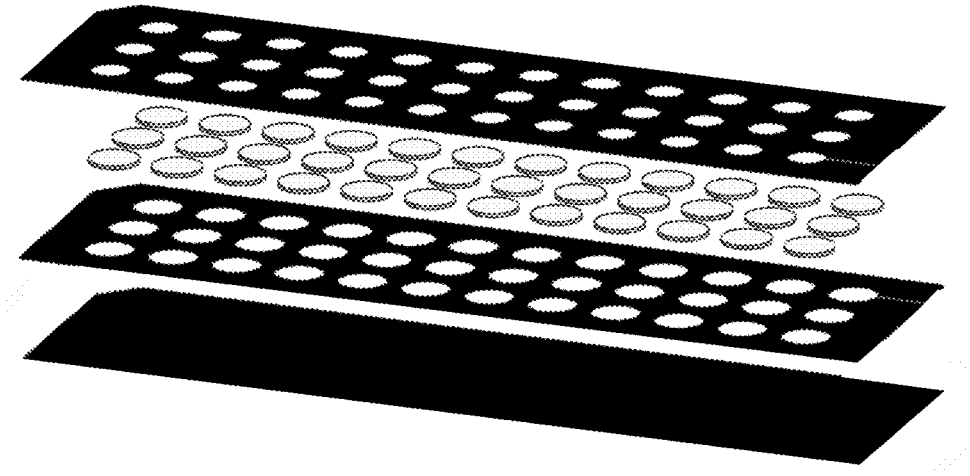
FIG. 3 is an exploded perspective view of a representative paper-based, 36-well plate device.
Figure 4:
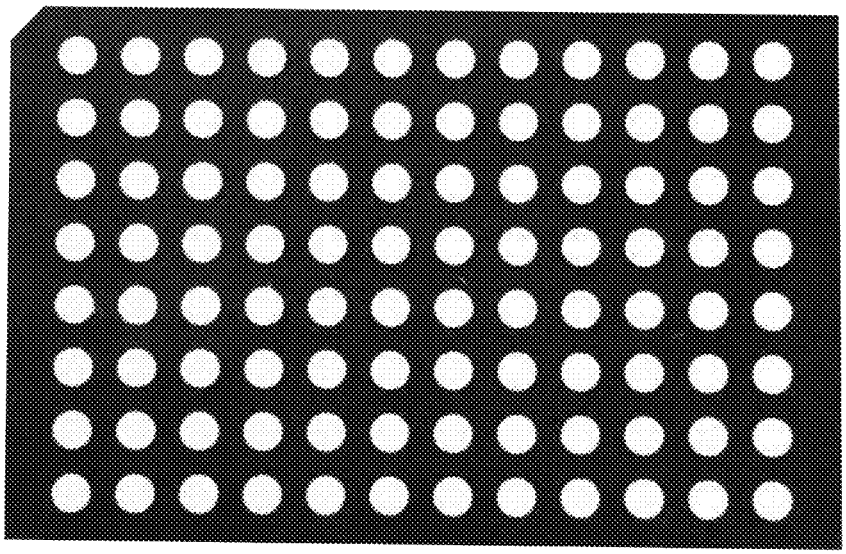
FIG. 4 is an image showing a top view of an assembled paper-based, 96-well plate device.

A representative paper-based well plate embodiment 200 is illustrated in FIG. 2. Paper-based well plate device 200 comprises four substrates, a bottom substrate 202, an intermediate substrate 204, a sensor substrate 206, and a top substrate 208. Each of the intermediate substrate 204 and the top substrate 208 is configured to comprise a plurality of rows of openings 210 and 212, respectively, to thereby provide a platform representing a well plate device used in various applications, such as analyte analysis, biological assays, chemical assays, and the like. The sensor substrate 206 comprises a plurality of individual sensor substrate substrates 214 that are fabricated to match the size, shape, and configuration of openings 210 of the intermediate substrate 204. Top substrate 208 comprises openings 212, which are fabricated to have a smaller diameter than that of the individual sensor substrate substrates 214. While a particular number of openings (e.g., 96 openings) and individual sensor substrate substrates (e.g., 96 openings) are depicted in FIG. 2, the present disclosure is not limited to this particular embodiment and contemplates other embodiments wherein more or fewer individual sensor substrate substrates and wells are provided. Also, the shape and size of each opening of the intermediate substrate and the top substrate can vary as described above and in some embodiments can be wells rather than openings. Additional representative paper-based well plate devices are illustrated in FIGS. 3 and 4. In some embodiments, the device can be a 6-well plate device, a 24-well plate device, 36-well plate device, a 96-well plate device, a 384-well plate device, a 1080-well plate device, a 1536-well plate device, and so on.

As indicated above, the devices described herein can be modified to comprise a signaling agent. For example, devices can be fabricated with a sensor substrate in which a signaling agent is embedded. Suitable signaling agents can include, but are not limited to, fluorescent compounds (e.g., fluorophores), chromogenic compounds (e.g., dyes), quantum dots, a member of a specific binding pair (which can emit a signal upon specific binding with another member of the specific binding pair), and the like. In some embodiments, the substrate-based analytical devices can further comprise a separate signaling agent substrate comprising wells in which a signaling agent can be deposited. The signaling agent substrate can be positioned within the substrate-based analytical device such that it is placed between an intermediate substrate of the device and a sensor substrate of the device, or such that it is placed between a top substrate of the device and a sensor substrate of the device. In additional embodiments, the devices can be modified with chemical reagents typically used in clinical analytical methods. The chemical reagents can be provided by the sensor substrate or another substrate added into the device.

Figure 5:
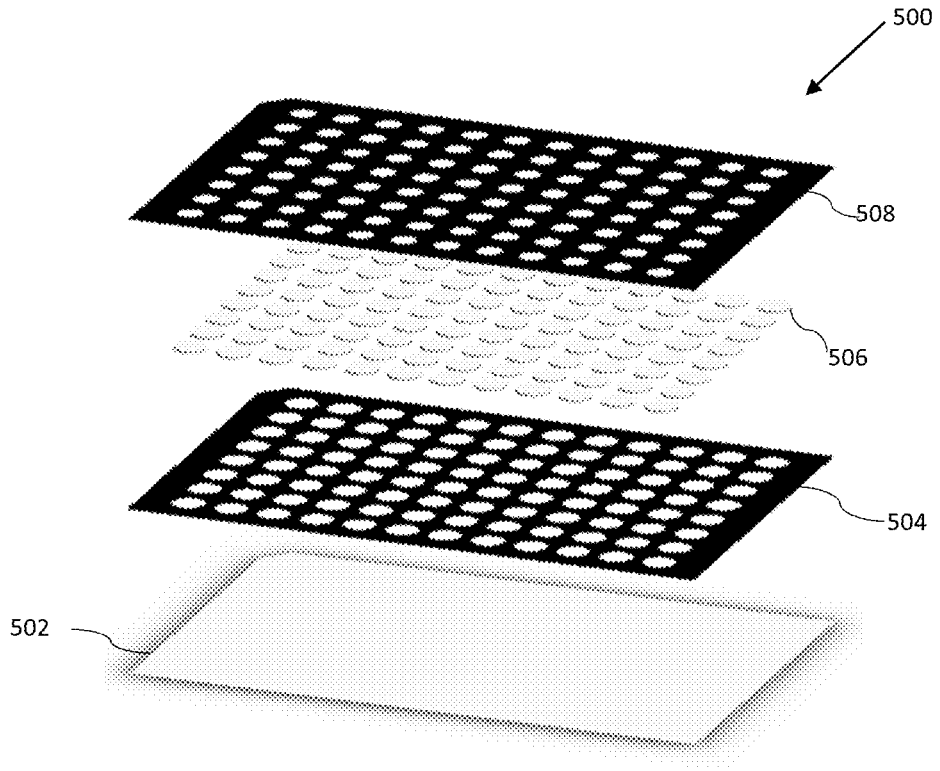
FIG. 5 is an exploded perspective view of a representative paper-based, 96-well plate device with transparent bottom layer such that any generated signal produced during use of the well plate device can be detected either from viewing the well plate device from the top or bottom.

The devices disclosed herein also can comprise one or more stacking layers that are introduced to increase the volume of sample that the device can hold and/or to provide multiple different reagents for analysis. In some embodiments, a plurality of stacking layers having hydrophilic sections and/or openings configured to match the shape, size, and/or pattern of wells and/or openings of a top and/or intermediate substrate can be provided. These hydrophilic sections provide the ability to absorb more sample when using the device as there are multiple layers of hydrophilic surfaces into which the sample can be absorbed. In yet additional embodiments, multiple stacking layers can be used wherein each stacking layer has regions in which a different reagent has been absorbed, these regions matching the shape, size, and/or pattern of wells and/or openings of the top and/or intermediate substrates. As such, when a sample is introduced into the wells and/or openings of the device, it can pass through multiple different reagent layers provided by the stacking layers. In such embodiments, a transparent bottom layer can be used so that any generated signal can be detected (e.g., visually or using a spectroscopic technique, such as UV-Vis spectroscopy) after the sample has passed through the different layers of the device. Exemplary transparent bottom layers can be made from materials such as polycarbonates, polystyrenes, and PET. Alternatively, a non-transparent or opaque bottom layer may be used such that detection can occur from viewing the top of the device. An exemplary stacking layer 502 is illustrated in device 500 illustrated in FIG. 5, which also comprises an intermediate substrate 504, a plurality of sensor substrates 506, and a top substrate 508.

Figure 6:
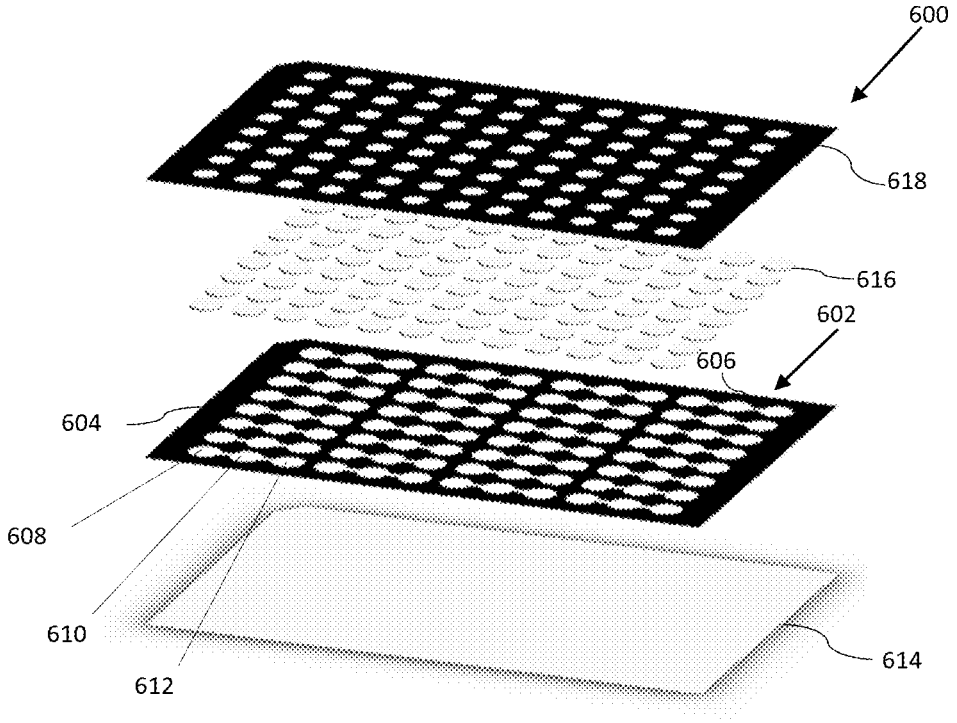
FIG. 6 is an exploded perspective view of a representative paper-based 96-well plate device comprising fluidic channels between the openings of the intermediate substrate component of the device.

Also disclosed herein are embodiments of hybrid microfluidic polymer-based analytical devices. Such devices integrate fluidic channels in combination with the well plate or strip device embodiments described herein. For example, a microfluidic architecture of channels can be embedded in a substrate such that the different wells and/or openings of a substrate can be connected via the channels. In these devices, the channels are defined in a manner equivalent to that which defines the wells and/or openings, by use of a hydrophobic barrier. The channels can be low-volume flow paths that connect the wells and/or openings while ensuring that only a minimal volume of the sample or a solvent may be retained in the channels following their use. See, for example, FIGS. 6, 7, and 8, which illustrate well plate embodiments wherein multiple wells and/or openings are connected with fluidic channels. As illustrated in FIG. 6, device 600 comprises plural sets of three openings 602, which are made in the intermediate substrate 604 and are connected via fluidic channel 606. One opening (e.g., 608) can serve as a sample introduction zone; a second fluidly coupled opening (e.g., 610) can serve as a reagent zone; and a third fluidly coupled opening (e.g., 612) can serve as a detection zone. Device 600 further comprises a stacking substrate 614, which can be made from opaque or transparent materials; a plurality of sensor substrates 616; and a top substrate 618. In yet additional embodiments, a stacking layer can be configured to act as a sump that can work with a one-way valve that is used to control flow through fluidic channels that connect different wells and/or openings of a substrate of the device. In some embodiments, the valve can comprise a low melting polymer (e.g., PCL or another hydrophobic polymer disclosed herein), solid oils (e.g., coconut oil, hydrogenated coconut oil, and the like), and/or wax (e.g., paraffin wax, beeswax, and the like) that can be melted using a suitable technique (e.g., a $CO_2$ laser). The valves can be actuated (that is, opened) by selectively melting the low melting polymer valve, such as by focusing a low-energy laser beam at the desired region to be melted. In yet additional embodiments, a metallic nanoparticle ink can be inkjet-printed onto the back of a given layer (e.g., bottom layer or intermediate layer) to build a heater element. Such embodiments can be used to deliver a given temperature for purposes of valve actuation (e.g., having heater elements both above and below could allow for the valves to be more than just single-use), or to provide the capability to incubate a reaction or other process. The materials making up the valves can be selected to have different melting points, but it also is feasible to have a single base material in two molecular weight increments having differing melting points. The low melting polymer layer positioned above the substrate comprising the actuated valve can be selectively heated to facilitate melting of the low melting polymer layer such that the low melting polymer is able to refill the space previously occupied by the valve prior to actuation. By allowing the low melting polymer to cool, the valve can be reformed because the low melting polymer will solidify within the fluidic channel. In yet some embodiments, a two-stage valve system can be provided by using two low melting components, wherein one melts at a lower temperature than the other so that a first valve can be operated and then the second valve provided by the second higher melting component can be actuated using a higher melting temperature. For example, a two-stage valve system could involve opening the first valve at 24° C. and then further increasing the temp to 36° C. (or higher) to open the second valve using a built-in incubation component and or a laser or other method of localized heating (e.g., custom electrically-driven heaters positioned in an area near the valve material). A built-in heater could comprise adding an etched foil silicon-rubber/polyester heater circuit as an intermediate layer of the device or by inserting a NiChrome wire in a layer of the device. By melting the polymer or wax, the channel is opened so that fluid can flow through the fluidic channel into a fluidly connected well or opening. In some embodiments, a layer of low melting polymer and/or wax can be added between substrates of the device to provide a mechanism for reclosing such valves. Solely by way of example, a layer of a low melting polymer can be included above a substrate comprising fluidic channels with valves as discussed above.

Figure 7:
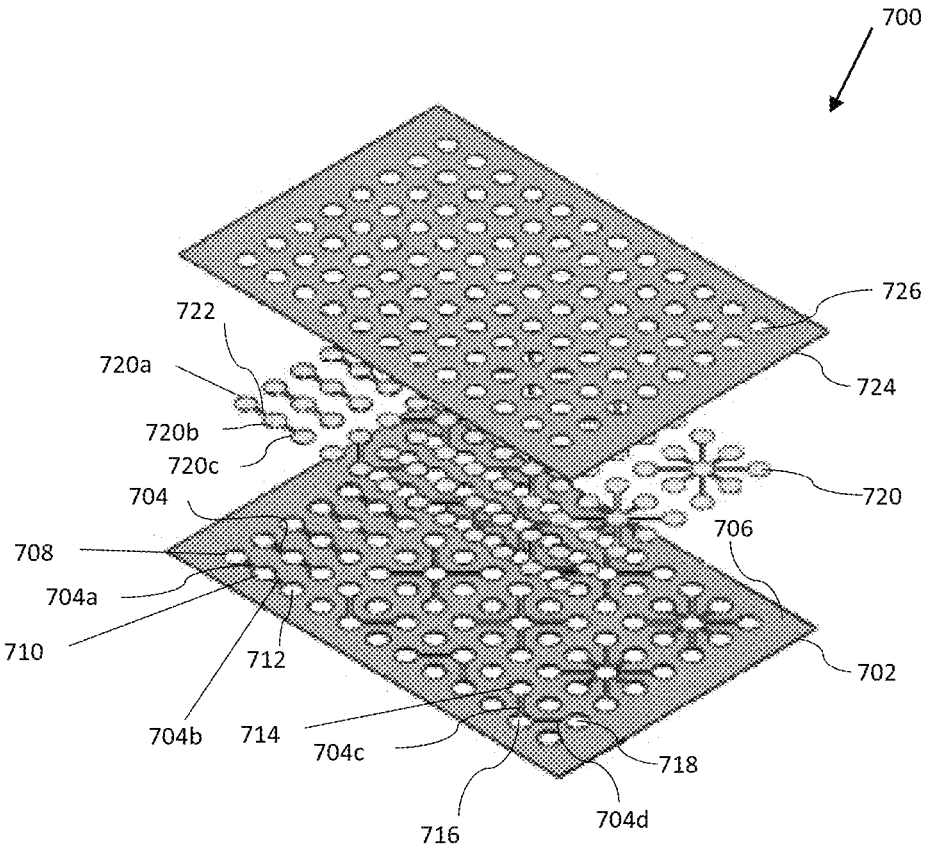
FIG. 7 is an exploded perspective view of a paper-based microfluidic well plate with multiple openings connected together allowing for multistep assays or multiple tests from a single sample to be conducted using the device.
Figure 8:
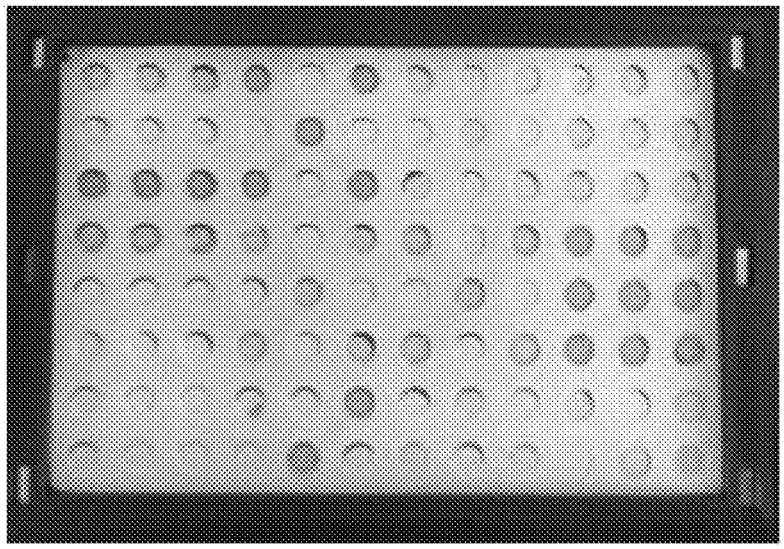
FIG. 8 is top view image of a microfluidic well plate having openings connected with fluidic channels whereby different dyed fluids are used to illustrate the interconnected nature of the openings.

A representative hybrid well plate device is illustrated in FIGS. 7 and 8. As illustrated in FIG. 7, different wells and/or openings can be fluidly connected using fluidic channels. According to device embodiment 700 of FIG. 7, an intermediate substrate 702 is configured to comprise a plurality of fluidic channels 704 embedded within surface 706 of substrate 702. Multiple different fluidic channel configurations can be used. For example, fluidic channels 704*a* and 704*b* are used to provide a linear configuration between openings 708, 710, and 712. In another example, fluidic channels 704*c* and 704*d* can provide a "v-shaped" configuration between openings 714, 716, and 718. Other exemplary fluidic channel configurations are illustrated in FIG. 7. Also, as illustrated in FIG. 7, multiple different sensor substrates 720 can be provided. These sensor substrates can be arranged in configurations that match different opening/fluidic channel patterns provided in intermediate substrate 702. For example, sensor substrates 720*a*, 720*b*, and 720*c* can be arranged in a linear configuration and connected via a hydrophilic portion 722 which is configured to fit within fluidic channels 704*a* and 704*b*. A top substrate 724 also is provided which has a plurality of openings 726 that allow one to view any signals generated within one or more openings of the intermediate substrate.

The substrates of the disclosed substrate-based analytical devices can have thicknesses that are the same or different from one another. In some embodiments, the bottom and intermediate substrates can have thicknesses ranging from 0.45 mm to 1.35 mm, such as 0.45 mm to 0.9 mm, or 0.5 mm to 0.8 mm. In representative embodiments, the bottom and intermediate substrates are 0.45 mm thick. In some embodiments, the top substrate can have a thickness ranging from 0.1 mm to 0.45 mm, such as 0.1 mm to 0.2 mm, or 0.1 mm to 0.15 mm. In representative embodiments, the top substrate is 0.15 mm thick. In some embodiments, the stacking layers and/or sensor layers described above can have similar thicknesses as the bottom, top, and/or intermediate substrates. In particular disclosed embodiments, the sensor layer is thinner than the other layers to provide tighter connections between the different layers.

The hydrophobic polymer component of the disclosed substrate-based analytical devices can be a polymer having a structure satisfying a Formula I Formula I

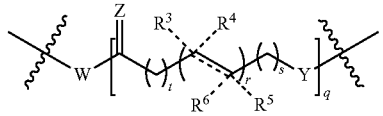

With reference to Formula 1, Z, Y, and W independently can be O, S, NH, or $NR^2$, where $R^2$ is selected from hydrogen, aliphatic, aryl, and heteroaryl; each of $R^3$, $R^4$, $R^5$ and $R^6$ (if present) independently can be hydrogen, aliphatic, aryl, heteroaryl, or a heteroatom-containing moiety (e.g., halogen; aldehyde (—$R^a$CHO); acyl halide (—$R^a$C(O)X, where X is selected from fluorine, chlorine, bromine, and iodine); carbonate (—$R^a$OC(O)O$R^b$); carboxyl (—$R^a$C(O)OH); carboxylate (—$R^a$COO$^-$); ether (—$R^a$O$R^b$); ester (—$R^a$C(O)O$R^b$, or —$R^a$OC(O)$R^b$); hydroxyl (—$R^a$OH); ketone (—$R^a$C(O)$R^b$); silyl ether ($R^bR^cR^d$SiO$R^a$—); peroxy (—$R^a$OO$R^b$); hydroperoxy (—$R^a$OOH); phosphate (—$R^a$OP(O)$(OH)_2$); phosphoryl (—$R^a$P(O)$(OH)_2$); phosphine (—P$R^aR^bR^c$); thiol (—$R^a$SH); thioether/sulfide (—$R^a$SR); disulfide (—$R^a$SS$R^b$); sulfinyl (—$R^a$S(O)$R^b$); sulfonyl (—$R^a$S$O_2R^b$); carbonothioyl (—$R^a$C(S)$R^b$ or —$R^a$C(S)H); sulfino (—$R^a$S(O)OH); sulfo (—$R^a$S$O_3$H); thiocyanate (—$R^a$SCN); isothiocyanate (—$R^a$NCS); oxazole; oxadiazole; imidazole; triazole; tetrazole; amide (—$R^a$C(O)N$R^bR^c$, or —$R^a$N$R^b$C(O)$R^c$); azide ($N_3$); azo (—$R^a$NN$R^b$); cyano (—$R^a$SCN); isocyanate (—$R^a$NCO); imide (—$R^a$C(O)N$R^b$C(O)$R^c$); nitrile (—$R^a$CN); isonitrile (—$R^a$N$^+$C$^-$); nitro (—$R^a$N$O_2$); nitroso (—$R^a$NO); nitromethyl (—$R^a$C$H_2$N$O_2$); and amine (—$R^a$N$H_2$, —$R^a$NH$R^b$, —$R^a$N$R^bR^c$); wherein $R^a$ is a bond, aliphatic, aryl, heteroaliphatic, or heteroaryl; $R^b$, $R^c$, and $R^d$ independently are hydrogen, aliphatic, aryl, heteroaliphatic, heteroaryl, or any combination thereof; r is an integer selected from 1 to 4; s and t independently are integers selected from 0 to 4; and q is an integer selected from 1 to 1000.

In particular disclosed embodiments, the hydrophobic polymer component has a structure satisfying Formula II or Formula III:

Formula II

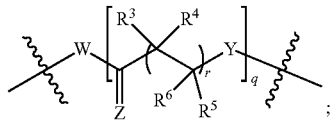

Formula III

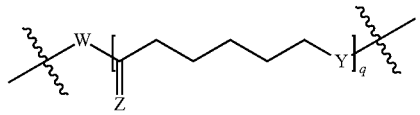

In particular disclosed embodiments, the hydrophobic polymer has a structure satisfying Formula IV.

Formula III

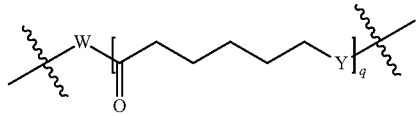

In yet additional embodiments, the polymer can be a polyvinyl polymer, such as polyethylene, polypropylene, polyvinyl chloride, or combinations thereof. Certain embodiments concern using polycaprolactone (also referred to herein as "PCL"), polycaprolactone diol, polycaprolactone triol, polycaprolactone-block-polytetrahydrofuan-block polycaprolactone, poly(ethylene oxide)-block-polycaprolactone, poly(ethylene glycol)-block-poly(e-caprolactone) methyl ether, polyvinyl chloride, or any combinations thereof as the hydrophobic polymer.

The hydrophobic polymer typically is used to coat the substrates of the device as described herein. In particular disclosed embodiments, a coating of the hydrophobic polymer can have a thickness ranging from surface films of 0.01 μm to 5 μm or may consist of an embedded (permeating) format. In such permeating embodiments, a particular amount of the hydrophobic polymer can be added to the substrates such that it partially permeates or completely saturates the substrates. In such embodiments, the amount of the polymer added can range from 5 mL to 15 mL of 5% PCL in toluene, such as 8 mL to 10 mL of 5% PCL in toluene, or 10 mL of 5% PCL in toluene. In particular embodiments the hydrophobic polymer is entirely within the matrix of the support material from a depth of 0.1% to 100% of the depth of the substrate.

Also disclosed herein are embodiments of additional device components that can be used in combination with the substrate-based analytical devices disclosed herein. For example, a plate frame, an alignment component, and a combined device comprising these components are disclosed. The plate frame and the alignment component can be used to house a strip-based device or a well plate device as described above such that proper alignment of the components of the disclosed strip-based and well plate devices is obtained and that the substrate-based analytical devices further are properly aligned with plate readers and/or liquid handling instrumentation that may be used in analytical techniques using the disclosed devices. In some embodiments, the plate frame is a well plate frame that is fabricated to hold a 6-well plate device, a 24-well plate device, 36-well plate device, a 96-well plate device, a 384-well plate device, a 1080-well plate device, or a 1536-well plate device described herein.

In particular disclosed embodiments, the plate frame and alignment component are reusable and can be fabricated using 3-dimensional printing. The plate frame component typically comprises first and second components. In some embodiments, the second component can be fabricated to match (or substantially match) the dimensions of the substrate-based strip and/or substrate-based well plate device to be used with the frame. In some embodiments, the first component can facilitate clamping the substrate-based analytical device in place and can be fabricated to comprise a plurality of openings that match a configuration of wells and/or openings in a substrate-based device described herein. Other configurations of the first and second components are disclosed herein. In some embodiments, an alignment component can be fabricated that has a shape similar to the second component of the plate frame and that fits around the exterior of the second component to facilitate alignment as discussed above. The plate frame and the alignment device can be designed to have any desired measurements using a suitable software program and then can be printed using a biodegradable polymeric material (e.g., polylactic acid (PLA)) and a 3-dimensional printer. In some embodiments, the components of the plate frame each comprise an outer perimeter section that is configured to align with the outer perimeter of the other component or to fit within or over the outer perimeter of the other component. When the first and second components are associated together, they will define a chamber that is capable of holding in place any one or more of the polymer-based analytical devices described herein. These components can facilitate use of the disclosed substrate-based analytical devices with benchtop components used in various analysis-based technologies, such as plate readers, plate washers, plate stackers/handlers, and dispensing components.

In some embodiments, magnets (e.g., Neodymium magnets) can be embedded in the first and second components of the plate frame (e.g., six magnets per section) at positions that will become aligned when the first and second components are pieced together (e.g., in the outer perimeter sections of the first and/or second components), thus allowing for strong clamping and self-alignment of the frame pieces around the substrate-based analytical devices. The magnets also can facilitate replacement of the substrate-based device while allowing the plate frame to be reused, thus reducing waste associated with well plate based assays.

Figure 9:
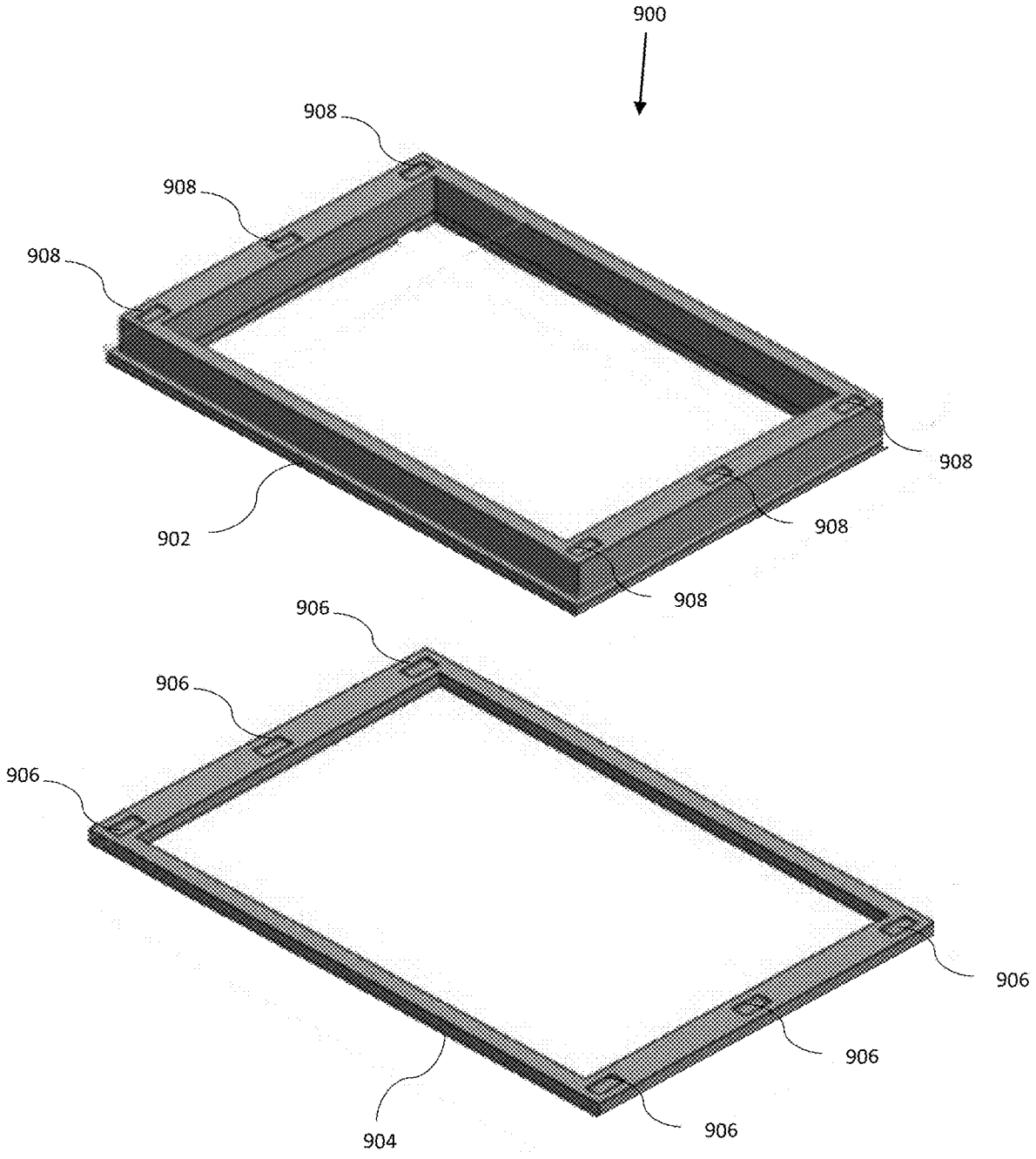
FIG. 9 is an exploded perspective view of a plate frame device embodiment comprising first and second components having magnets.
Figure 10:
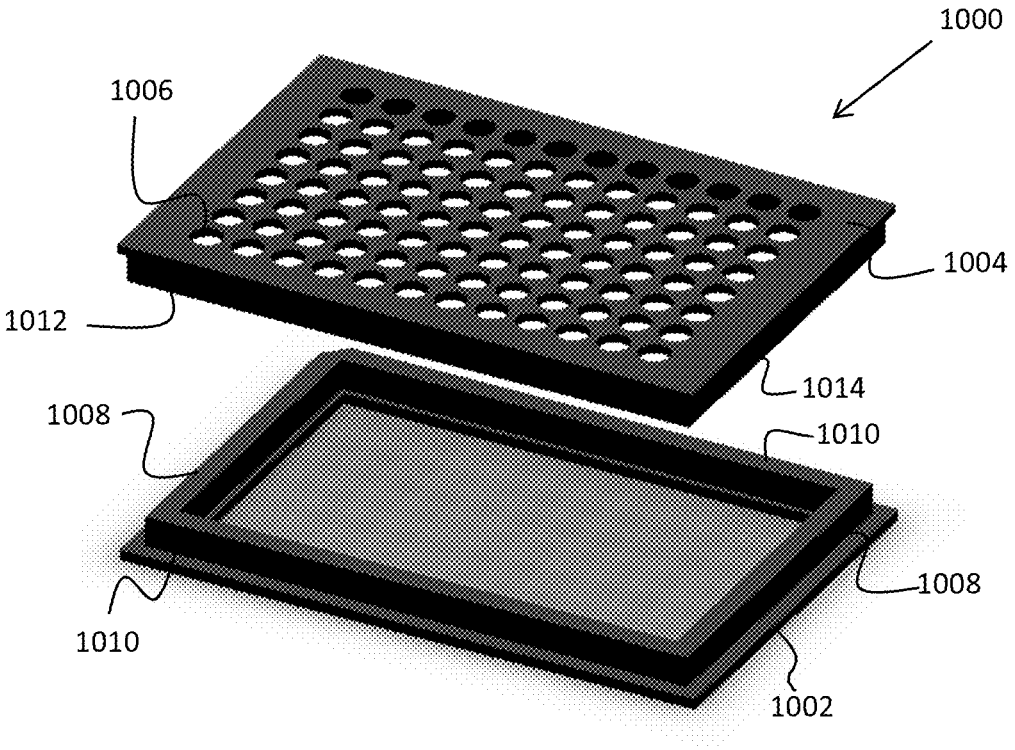
FIG. 10 is an exploded perspective view of a representative plate frame device.

A representative embodiment of a plate frame is illustrated in FIG. 9. Plate frame 900 comprises a second component 902 (which acts as the bottom of the plate frame) and a first component 904 (which acts as the top of the plate frame). First component 904 comprises housings 906 that are configured house magnets and that are configured to match the locations of housings 908, which also can house magnets, provided in second component 902. Another embodiment of a plate frame is illustrated in FIG. 10. FIG. 10 is an exploded perspective view of a plate frame device 1000, which comprises a second component 1002 and a first component 1004. As illustrated in FIG. 10, a plurality of openings 1006 can be made in the first component 1004, which are configured to match the configurations of the openings and/or wells of the well plate device placed in the holder such that a user can visualize signals generated using the well plate device. Second component comprises walls 1008 and 1010 and first component 1004 comprises walls 1012 and 1014. In the embodiment illustrated in FIG. 10, the first component 1004 and second component 1002 can be fit together such that walls 1008 and 1010 of the second component fit within walls 1012 and 1014 of first component 1004. In some embodiments, device 1000 can be modified to include magnets in one or more of walls 1008, 1010, 1012, and 1014 so that magnets in walls of the first component are magnetically attracted to magnets within walls of the second component. In some embodiments, the magnets can be embedded within walls 1008, 1010, 1012, and 1014 or they can be added to the exterior and/or interior of these walls.

Figure 11A:
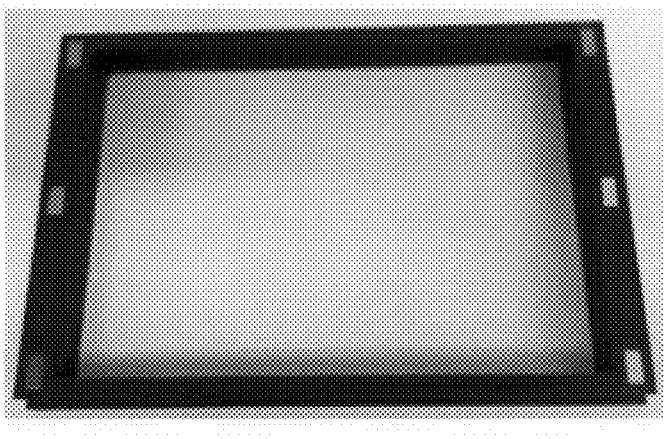
FIGS. 11A and 11B are images of components of a constructed magnetic plate frame device.
Figure 11B:
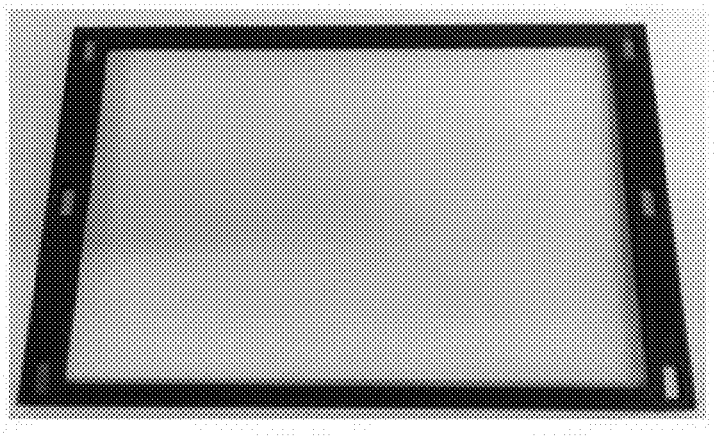
Figure 12:
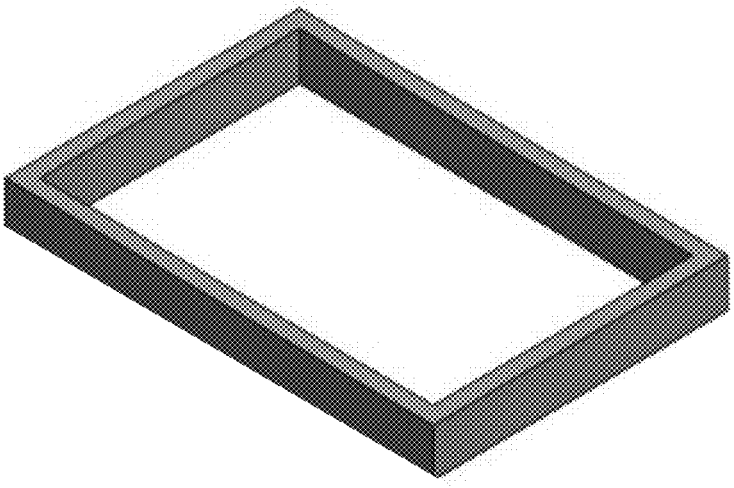
FIG. 12 is an illustration of a representative alignment device that friction fits a second portion of a plate frame device thus facilitating well plate substrate alignment upon addition of the magnetic first portion of the frame device.
Figure 13B:
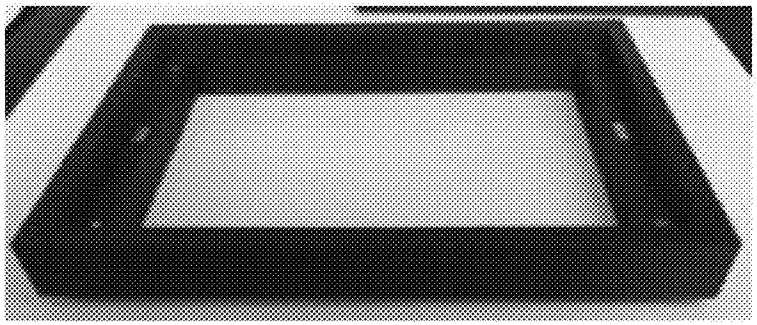
FIGS. 13A-13D are photographic images showing positioning and use of a representative alignment device (FIG. 13A) to align well plate substrates (FIG. 13C) and the first and second components of a plate frame device (FIGS. 13B and 13D).
Figure 13A:
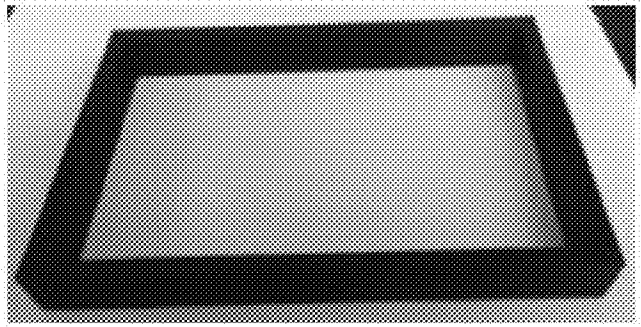
Figure 13D:
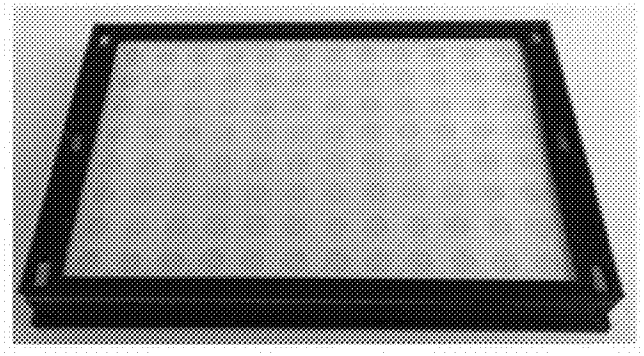
Figure 13C:
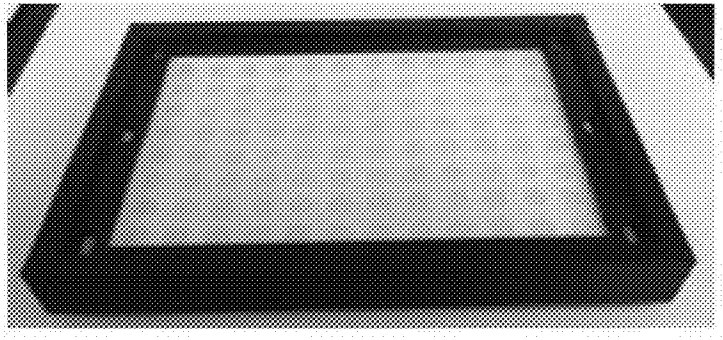

FIGS. 11A and 11B are photographic images of representative first and second components of a plate frame device. FIG. 12 is an illustration of an alignment component that can be used to align the first and second components when combined with different substrates described herein. FIGS. 13A-13D show representative plate frame and alignment components at various stages of implementation. FIG. 13A shows an alignment component; FIG. 13B shows the alignment component combined with a second component of a plate frame; FIG. 13C shows the positioning of a well plate device within the plate frame and alignment component and FIG. 13D shows the well plate device within the completed plate frame after the alignment component is removed.

IV. Methods of Making Devices

Disclosed herein are embodiments of methods for making the substrate-based analytical devices described herein.

In some embodiments, the methods can comprise depositing a hydrophobic polymer as described herein on a substrate of the device (e.g., a bottom substrate, an intermediate substrate, a top substrate, or any combination thereof). In some embodiments, the hydrophobic polymer can be deposited as a solution (e.g., wherein the hydrophobic polymer is dissolved in a solvent, such as toluene) or as a thin film (e.g., wherein the hydrophobic polymer is melted and then deposited as a thin film without using a solvent). Using the hydrophobic polymer, the chemical properties of the substrate can be modified such that hydrophilic substrates are converted to hydrophobic substrates (e.g., by coating the substrate or a portion thereof with the hydrophobic polymer). In yet additional embodiments, non-hydrophilic substrates can be rendered hydrophilic using the hydrophobic polymer. For example, a non-hydrophilic substrate can be coated with the hydrophobic polymer and then a portion of the substrate comprising the hydrophobic polymer can be treated with $O_2$ plasma to render the treated surface hydrophilic. In some embodiments the substrate itself can be treated with an $O_2$ plasma treatment to render the substrate surface hydrophilic. Hydrophilic regions formed on a substrate by treating only a portion of the substrate (or by treating a masked substrate as described below) with the hydrophobic polymer serve as wells of the substrate in some embodiments.

Figure 14A:
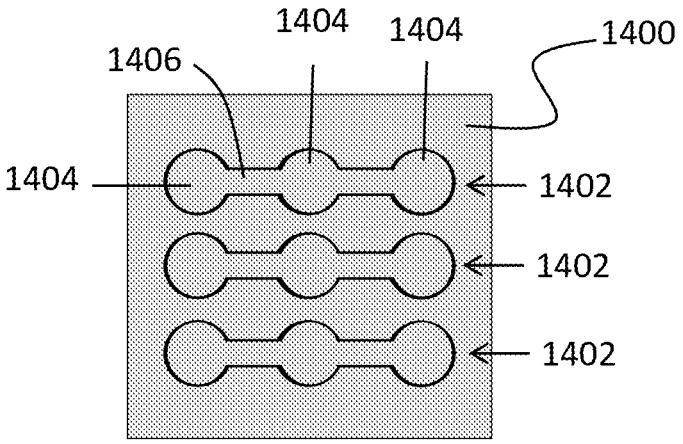
Figure 15A:
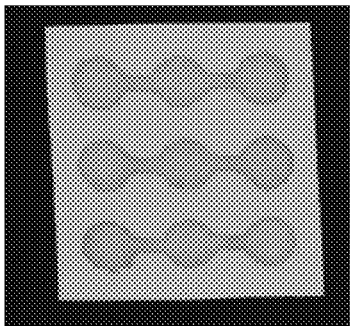
FIGS. 15A-15C are images of a representative device as illustrated in FIGS. 14A-14C after being treated with dye-containing samples to visualize fluid flow through the wells and fluidic channels of the device.
Figure 14B:
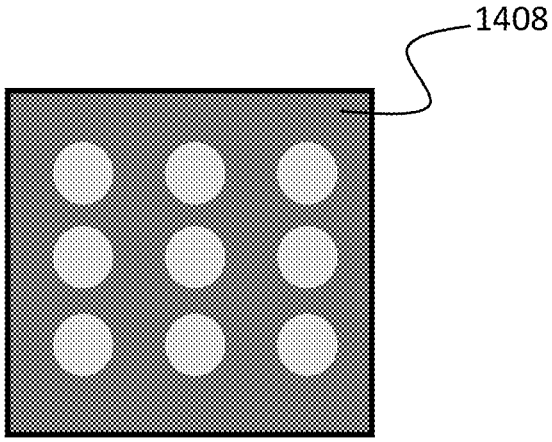
Figure 15B:
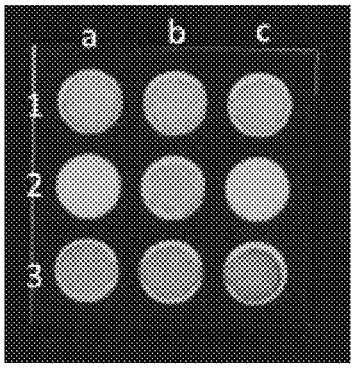
Figure 14C:
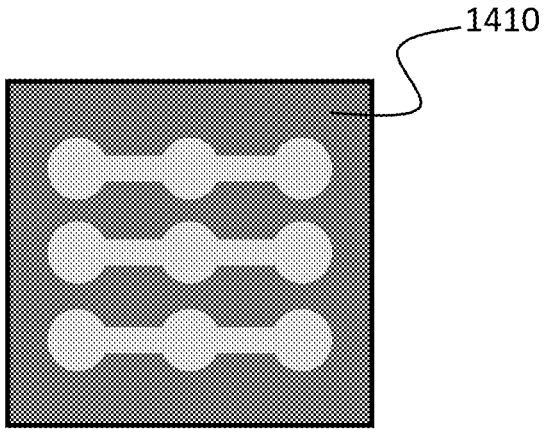
Figure 15C:
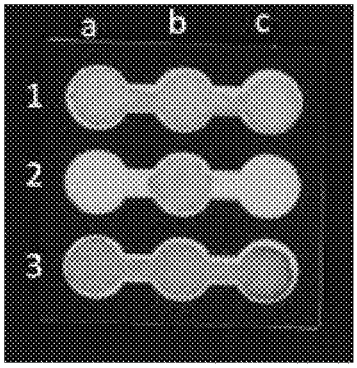

The methods can further comprise masking a substrate of the device, such as an intermediate substrate or a top substrate, with a suitable masking agent (e.g., a masking tape) prior to depositing the hydrophobic polymer. The masked substrate can then be patterned using a suitable patterning device, such as a laser cutter, plotting cutter, or even manual cutting. After patterning, a portion of the masking agent can be removed from the substrate and the substrate can be covered with a solution of the hydrophobic polymer using any suitable technique (e.g., airbrushing, spraying, dipping, inkjet deposition, or the like), thereby rendering the unmasked regions of the substrate hydrophobic. The substrate can then be dried (using an affirmative drying step where the substrate is exposed to heat, air flow, or an inert gas flow; or simply allowing the substrate to dry in ambient atmosphere). The remaining masking agent can then be removed to expose a patterned substrate comprising hydrophilic regions. In yet additional embodiments, substrates that are to be patterned can first be coated with a solution of the hydrophobic polymer and then patterned by cutting the desired pattern into the polymer-coated substrate (using cutting techniques described above). Patterned regions of the substrate can then be treated with an $O_2$ plasma treatment to render the patterned regions hydrophilic thereby forming wells. In some embodiments, fluidic channels can be formed in the substrates to join different wells and/or openings. For example, fluidic channels can be laser (or manually) cut into the hydrophobic polymer component surrounding the perimeters of the wells and/or openings and thus expose a region of the substrate which can serve as a channel through which fluid can flow from one well/opening to another. In yet some additional embodiments, well and/or channel architectures can be patterned on a substrate (e.g., an intermediate substrate) by screen printing a polymer onto the substrate to thereby define hydrophilic wells and/or channels. In some embodiments, screen printing facilitates the ability to produce substrates having different architectures, such as single wells, or wells that are connected through a fluidic channel. Such connections can facilitate fluid transfer from one well to another. For example, as illustrated in FIGS. 14A-14C, the patterned substrate 1400 (shown in FIG. 14A), which comprises three different well/fluidic channel configurations 1402, can be used in a device to facilitate transferring assay components from one well 1404 to another well 1404 via a fluidic channel 1406. The device shown in FIG. 14B comprises a top substrate 1408 configured with openings that allow the use to visualize the wells of patterned substrate 1400. The device shown in FIG. 14C includes a top substrate 1410 that is configured to comprise wells and fluidic channels matching those of substrate 1400 so that fluid movement through the fluidic channels can be visualized. As further illustrated by FIGS. 15A-15C, well and fluidic channel configurations like those illustrated in FIGS. 14A-14C can be used to transfer reagents and/or assay components from well to well. Differently dyed fluids are used in FIGS. 15A and 15C to illustrate fluid flow through the device. As shown by FIG. 15B, an assay component (represented by blue dye) is immobilized on wells positioned in column b, rows 2 and 3. The previously deposited assay component is reconstituted with the sample flow (represented by red dye). Once the sample is added to the well of column a, row 3, the previously deposited assay component on the well of column b, row 3 re-dissolves and the mixture (containing both red and blue dyes) will travel to the well of column c, row 3.

The fluidic channels of device embodiments described herein can have any suitable dimension, such as 25 μm to 5 mm (or higher) with the average width in the range of 100 μm to 250 μm. The height of the channel typically is defined by the thickness of the layer. For example, if standard filter paper is used, the channel could have a thickness ranging from 150 μm to 200 μm. In some embodiments, the length of the channel can be on the order of several millimeters in length. For example, lower density plates (e.g., 96-well plates) can have channels on the order of several mm, while higher density plates (e.g., >384-well plates) may have much shorter channels (e.g., micrometer and/or nanometer length channels).

Figure 16A:
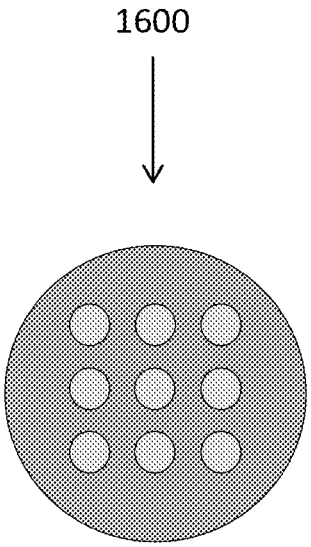
Figure 16B:
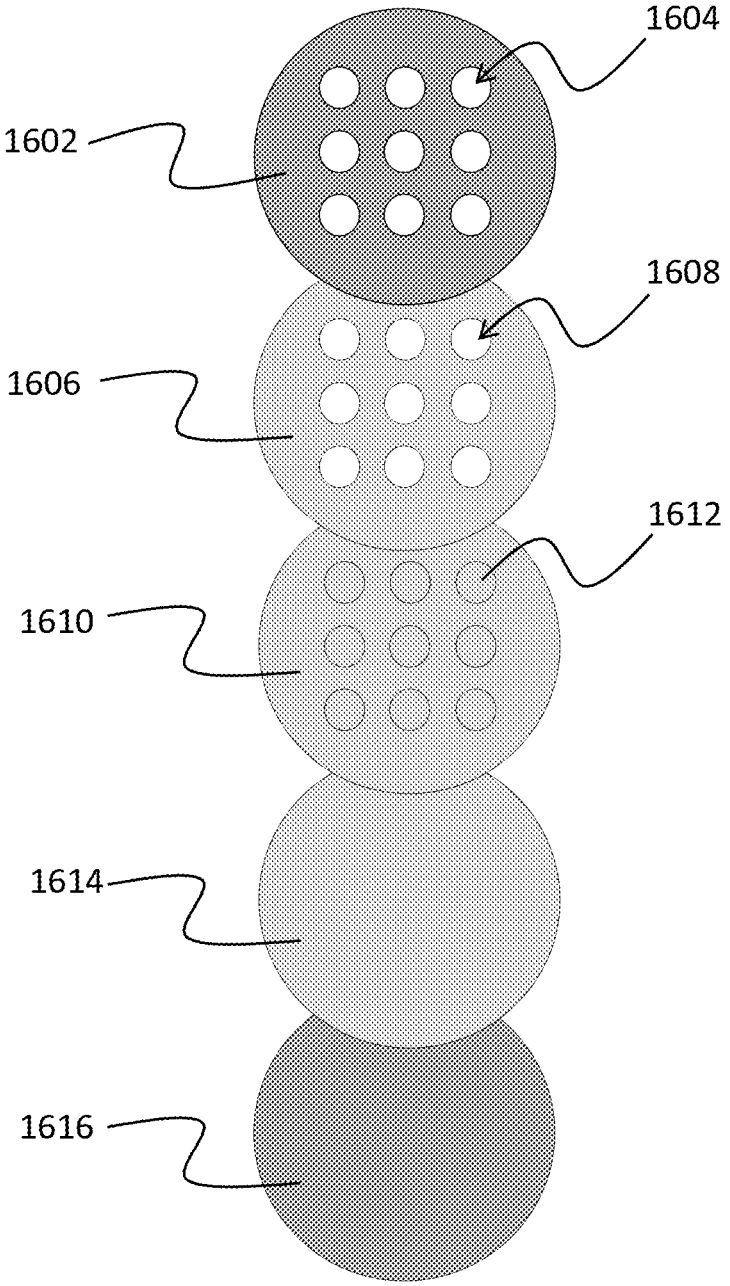

For substrates that do not require patterning (e.g., a bottom substrate), the substrate can simply be coated with a solution of the hydrophobic polymer without patterning. These substrates can be dried and then combined with the other substrates of the device using a manual coupling technique (e.g., stacking the substrates and then holding them together with a clamping mechanism) or using a laminating coupling technique (e.g., stacking the substrates together and then using a thermal laminator to press the substrates together). For example, in some embodiments, a top substrate, a sensor substrate, and an intermediate substrate can be stacked such that the sensor substrate is positioned between the top and intermediate substrates. These substrates can then be laminated together. Then a bottom substrate can be laminated to these combined substrates. In yet additional embodiments, multiple substrates with openings, wells, and/or channels can be stacked such that a device comprises one or more substrates with openings, one or more substrates with wells, one or more non-patterned substrates, and any combinations thereof. An exemplary stacked device 1600 is illustrated in FIG. 16A. An exploded perspective view of device 1600 is illustrated in FIG. 16B. As illustrated in FIG. 16B, a colored (or otherwise non-transparent) top substrate 1602 comprising a plurality of openings 1604 is fluidly coupled with a first intermediate substrate 1606, which also is configured to comprise a plurality of openings 1608. This first intermediate substrate 1606 also is fluidly coupled with a second intermediate substrate 1610, which is configured to comprise a plurality of wells 1612 in a pattern matching openings 1604 and 1608 of top substrate 1602 and first intermediate substrate 1606. Non-patterned substrate 1614, which is coated with a hydrophobic polymer is associated with second intermediate substrate 1610 and also bottom, colored substrate 1616. All of these components are stacked and coupled together to provide constructed device 1600 as illustrated in FIG. 16A.

In additional embodiments, individual substrates (e.g., bottom, intermediate, and top substrates) of the device can be saturated with a solution of the hydrophobic polymer. The substrates can then be dried using techniques described above to provide an even distribution of the polymer on all surfaces of the substrate(s). A desired pattern can then be cut into one or more substrates (such as to provide an intermediate and/or top substrate). Patterned and non-patterned substrates are then stacked in a configuration described herein and laminated at a temperature suitable to melt the hydrophobic polymer (e.g., temperatures ranging from 60° C. to 120° C., such as 90° C. to 110° C., or 100° C. to 110° C.).

In yet additional embodiments, the methods described herein can comprise applying an even layer of the hydrophobic polymer (either as a solution or by adhering a film of the hydrophobic polymer) on a surface of a substrate, such as a polymeric sheet (e.g., a PET-based high temperature copier transparency sheet). The even layer of the hydrophobic polymer can be applied using a suitable coating technique, such as airbrushing, spraying, dipping, inkjet deposition, or the like. The substrate is then dried using techniques described above and then optionally patterned (such as to prepare an intermediate or top substrate). A bottom substrate, intermediate substrate, and top substrate made according to this method can then be combined with a sensor substrate such that the intermediate substrate is stacked on top of the bottom substrate, followed by the sensor substrate, and then the top substrate. In some embodiments, the polymeric sheet can be treated for use in fluorescence techniques by coating the polymeric sheet with a colored ink solution or with a layer of colored paper.

In embodiments described herein, the hydrophobic polymer not only can be used to coat the different substrates of the disclosed substrate-based analytical devices and/or to provide a defined pattern within or on a substrate of the device, but it also serves as a bonding agent to secure the different substrates together.

V. Methods of Use

In some embodiments, the disclosed substrate-based analytical devices and additional device components can be used for analytical analysis and high-throughput screening and analysis. In particular disclosed embodiments, the devices disclosed herein can be used for analyte detection techniques, such as detecting environmental or health toxins, chemical compounds (e.g., cyanide or other water contaminants), disease biomarkers, and the like. In additional embodiments, the devices can be used to complete multi-step assays that are typically conducted in well plates and/or multi-step assays that require multiple reagent additions and incubations, which can be conducted in a single step using the disclosed devices. For example, see FIGS. 6, 7, and 8, which illustrate device embodiments that can be used for plural assays at the same time. Device embodiments comprising polymeric substrates can be used for top or bottom reading in colorimetric and fluorescent/luminescent assays. In yet additional embodiments, the devices can be prefabricated with reagents used for clinical chemistry panels used in the medical field.

In some embodiments, the devices can comprise (or can be modified to comprise) a sensor substrate comprising a signaling agent that, once contacted with an analyte, can emit a signal, such as a fluorescent signal, colorimetric signal, or other signals described herein. In particular disclosed embodiments, the sensor substrate comprising the signaling agent can be exposed to an external sample (e.g., biological sample obtained from a subject or an environmental sample, such as water, air, soil, plants, or the like) in order to determine if the external sample comprises an analyte of interest. In other embodiments, the sample can be provided as part of the sensor substrate and the signaling agent can be added to the device so as to determine if the sample comprises an analyte of interest. In some embodiments, the devices can be used to quantify the amount of analyte present in the sample. For example, if a signal is emitted upon exposure of the signaling agent to an analyte, then this can correspond to a particular concentration of the analyte. In yet additional embodiments, the devices can be used to qualify the analyte present in the sample. For example, the generation of a signal (e.g., a particular color change, fluorescence, or quenched fluorescence) can indicate that a particular analyte is present in the sample. In some embodiments, the device can be used in combination with a reference chart (e.g., a color chart) that provides a reference for quantifying and/or qualifying the analyte detected using the disclosed devices. For example, a color chart can be used as a reference to determine a particular type of analyte present in a sample based on the color signal emitted from the sensor substrate after using the device. A user can visually compare the color signal emitted from the sensor substrate and can match it to a color on the color chart that correlates a particular type of analyte. In yet additional embodiments, the devices can be used in combination with a user's pre-existing laboratory plate reader for quantitative and/or qualitative analysis.

Embodiments utilizing fluidic channels connecting different wells/openings of a patterned substrate allow for complex analytic methods to be conducted using the disclosed substrate-based devices. For example, by connecting multiple wells/openings with fluidic channels, sequential steps of an assay can be performed, or multiple tests of a single sample can be conducted. Solely by way of example, a plurality of wells/openings can be joined with fluidic channels to provide (i) a sample introduction zone, which can be configured to accept a sample or a sensor substrate comprising a sample, (ii) a reagent zone, which can be configured to accept a sensor substrate comprising particular reagents for the type of test being conducted, (iii) and a detection zone, which can be configured to accept a sensor substrate comprising a signal generating moiety or a sensor substrate that emits an observable or measurable signal upon exposure to a fluid delivered from the reagent zone. Channels with fluidic channels can be used in techniques, such as absorbance spectroscopy (through the short or long dimension of the channel), emission spectroscopy, extraction, chromatography, electrophoresis, affinity sorptive processes, molecular recognition processes, electrochemical measurement processes, solution conductance or impedance measurements, and interfacing to external systems including spectrometers and other process or detection platforms.

Figure 17:
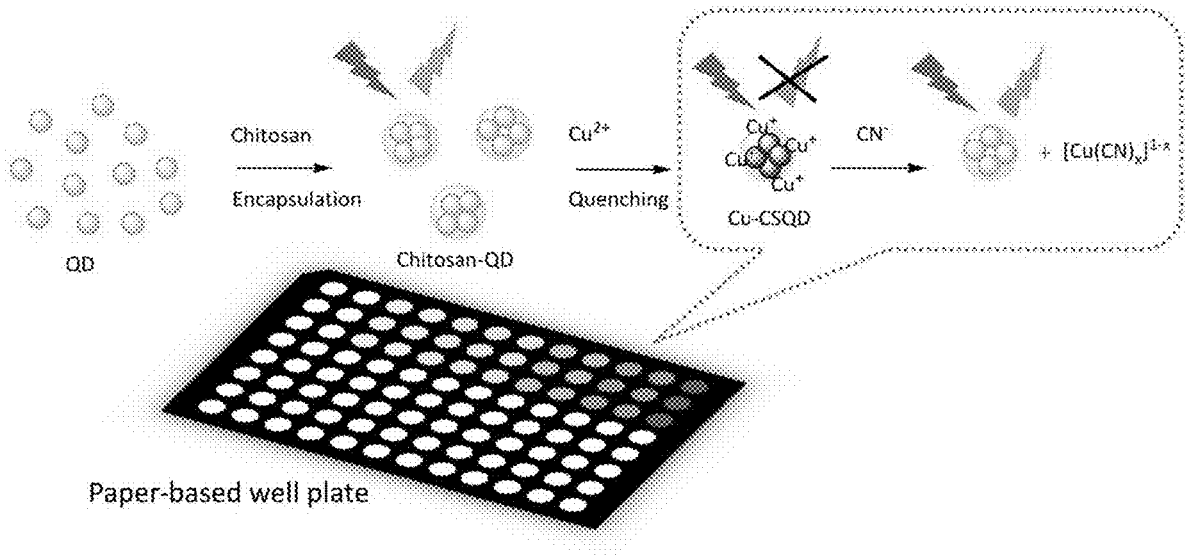
FIG. 17 is a schematic illustration of a method for using a substrate-based analytical device described herein in a cyanide detection method.

In some embodiments, the disclosed devices are used for cyanide detection as illustrated schematically in FIG. 17. Methods using the disclosed devices for cyanide detection are discussed below. The methods described below can be adapted for detection of other analytes capable of displacing ions (e.g., copper ions) from the surface of a quantum dot. In representative embodiments, a paper-based well plate device is use in combination with chitosan encapsulated CdTe quantum dots, having a maximum emission of 520 nm (CS-QD520), as fluorophores. Such quantum dots are specifically quenched by copper (II) ions. The quenched chitosan-QD nanoparticle are used as a sensor probe for cyanide detection. Upon cyanide introduction, the fluorescent signal is recovered due to the formation of copper cyanide complex $[Cu(CN)_x]^{1-x}$, thus freeing the chitosan-QD nanoparticle. The "signal-ON" fluorescence is graphed against cyanide at clinical relevant concentrations. The fluorescent assay can be pre-concentrated on the surface of a glass microfiber filter, which serves as a sensor substrate of the device. Such embodiments provide a higher signal compared to solution-based assays due to the higher surface-to-volume ratio of the assay. Each well (or opening) of the well plate can be run as an independent assay, which is able to analyze multiple samples simultaneously.

VI. Examples

Reagents—All the chemicals used were of analytical-reagent grade. Deionized water was obtained from a Milli-Q® Advantage A10. $CdCl_2$ (anhydrous, 99%), tellurium powder (~200 mesh, 99.8%), 3-mercaptopropionic acid (MPA, 99%), Sodium borohydride ($NaBH_4$, 98%), Chitosan (MW=50-190 KDa, 75-85% deacetylated) were purchased from Sigma-Aldrich (St. Louis, Mo., USA). Polycaprolactone (PCL, Capa™ 6800, MW=80 000) was obtained from Perstorp (Cheshire UK). Copper sulfate ($CuSO_4.5H_2O$) was purchased from Fisher Chemical (Fair Lawn, N.J., USA). Potassium Cyanide (KCN) was obtained from Mallinckrodt (Phillipsburg, N.J., USA). Black filter paper was purchased from Ahlstrom Filtration LLC (Mt. Holly Springs, Pa., USA). GF/B microfiber filter was purchased from Whatman GE healthcare (Buckinghamshire, UK). Black poster paper board was purchased from UCreate poster board, 22"×28" (Charlotte, N.C., USA).

Synthesis of Core CdTe Quantum Dot

CdTe Quantum dots were synthesized in aqueous solution as previously described with some modifications. Two mmol anhydrous $CdCl_2$ (0.3666 g) and 4.8 mmol 3-mercaptopropionic acid (418 μL) were mixed in 200 mL of Milli-Q water. The pH of the solution was adjusted to 11 using 1.0 M NaOH. The mixture was purged with $N_2$ gas for 30 min to eliminate oxygen from solution. The NaHTe solution was prepared separately by mixing 0.5 mmol tellurium powder (63.8 mg) and 5 mmol $NaBH_4$ (0.1891 g) in 5 mL Milli-Q water. The NaHTe precursor was added to the cadmium precursor solution and the mixture was refluxed at 95-100° C. for 3 hr. The final molar ratio of $Cd^{2+}$/MPA/NaHTe was 1:2.4:0.25, respectively. The average diameter and concentration of CdTe QDs were calculated as 1.76 nm and 81.7 μM, respectively.

Synthesis of Chitosan Encapsulated CdTe Quantum Dot (CS-QD)

Chitosan stock solution (1% w/v) was prepared by dissolving 1 g chitosan in 100 mL of 1% acetic acid. The stock solution was subsequently diluted to 0.01% by 0.1% acetic acid. As prepared CdTe QD solution (22 mL) was gradually added in 100 mL of 0.01% chitosan solution with stirring followed by addition of 1 mL EDC (10 mg/mL)/NHS (5 mg/mL) solution. The mixture was further stirred overnight at room temperature to form covalent bonds between carboxylic acid on quantum dot surface and amino group on chitosan. The chitosan encapsulated CdTe quantum dot was washed 3 times with Milli-Q water by centrifugation. In the final step, the precipitate was re-dispersed and stored in 22 mL (the same volume as QD520) phosphate buffer 10 mM, pH 7.4. The concentration of CS-QD would be 81.7 μM derived from QD520 concentration. The mass/volume concentration is 3.76 mg/mL.

Cyanide Probe—Quenching of CS-QD520 by Copper Ion

The stock chitosan-QD solution was diluted 10 fold with Tris-HCl buffer 10 mM pH 7. A certain amount of copper (II) standard (100 mg/L) was added to the diluted chitosan-QD solution with stirring to quench the fluorescence signal of CSQD520. The quenching reaction was continued for 3 hours. Twenty microliters of the quenched solution (Cu-CSQD520) was drop-casted on a circle piece of glass microfiber filters, grade GF/B (6.8 mm diameter) cut by a hole punch. The sensor dot was dried overnight at 40° C. in a vacuum oven.

Example 1

In this example, the paper based strip/plate was designed and drawn to resemble a standard 96-plastic well plate using SolidWorks® 2013 (Dassault Systèmes, Waltham, Mass., USA) shown in FIG. 2. The design contained three layers: bottom, middle, and top. The bottom and middle layer were composed of black poster paper (0.45 mm thickness). The top layer was composed of black filter paper (0.15 mm thickness). Each opening on the middle layer has a diameter of 6.8 mm to match with the GF/B sensor dot. The top layer contained openings with a diameter of 5.4 mm, which was smaller than the openings on the middle layer. This helped lock the GF/B sensor dots in place in the middle layer. The poster paper and the filter paper were cut using LASER cutter. All three layers and GF/B dot sensor were assembled together by air-brushing 5% polycaprolactone (PCL) in toluene in between the layers and the top surface. This made a hydrophobic barrier around each individual opening in the paper plate. Not only being used as a hydrophobic boundary, the PCL in-between layers also functioned as an adhesive, attaching each plate layer together.

A low-cost thermal laminator (Scotch, model TL902A) was used to press all layers together resulting in the melting of PCL on the paper surfaces. Two layers were laminated at a time; staring from Top and Middle layer, aligning GF/B sensor dots in the openings, and lastly laminating the bottom layer. PCL enabled hydrophobic barrier between each individual opening for each individual assay on the plate. The disposable strip/plate was stored in the vacuum-sealed bag until usage. The paper-based well plate was designed to be placed in a plate holder (described below), which was compatible to a tray of any standard plate reader.

Example 2

Disposable paper based strips or plates described above were equipped with plastic holders and ready for the detection. Twenty microliters of cyanide standards or samples were applied directly to the paper based strip/well plate. The liquid sample absorbed on the GF/B substrate and slowly reacted with the Cu-CSQD520 on the top surface of the glass membrane filter. A fluorescence signal was measured at 520 nm with the excitation wavelength at 350 nm.

Figure 18A:
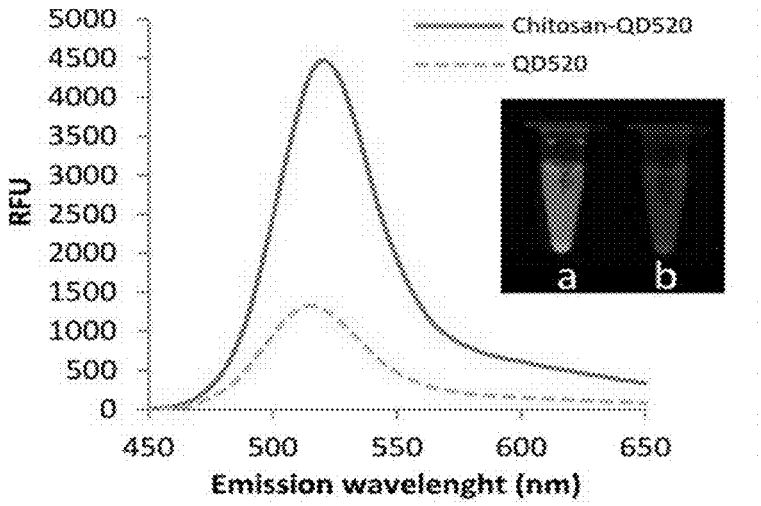
FIGS. 18A-18C illustrate characterization data of chitosan encapsulated CdTe QDs.
Figure 18B:
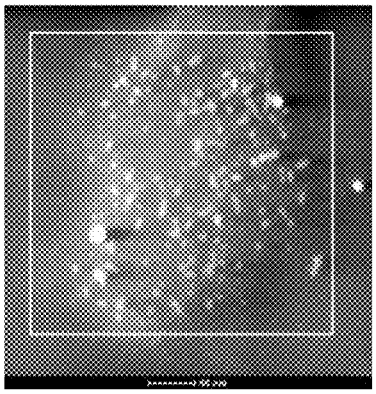
Figure 18C:
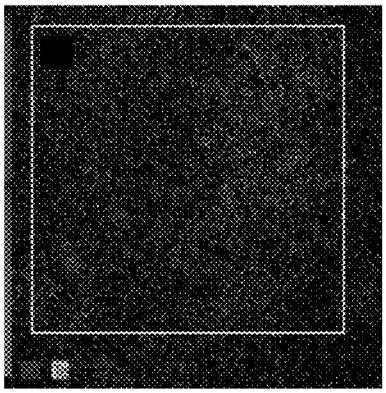

Chitosan encapsulated CdTe quantum dots with a maximum emission of 520 nm were synthesized in an aqueous solution and used as a fluorophore. The CS-QDs nanoparticles formed via the electrostatic attraction between positive charge of amino functional group on chitosan and negative charge of MPA on the QD surface. Both chitosan and QDs were covalently linked through amide bond formation by carbodiimide chemistry. The scan emission spectra of QD520 and CS-QD520 showed in FIG. 18A indicated that fluorescence intensity of CS-QD520 was 3.5 times higher than those of the original QD520 at the same mass/volume concentration. This exceptional phenomenon may result from the intrinsic properties of chitosan. Numerous amino and hydroxyl functional groups on the biopolymer are good capping agents, which helped stabilized the QDs surface. The morphology of CS-QD520 was studied by TEM (FEI Titan with ChemiSTEM mode) as shown in FIG. 18B, which revealed the irregular shape of the nanoparticles with the particle size about 10-25 nm. The elemental analysis from ChemiSTEM mode in FIG. 18C confirmed the presence of cadmium and telluride element in the chitosan encapsulated CdTe QDs.

Figure 19A:
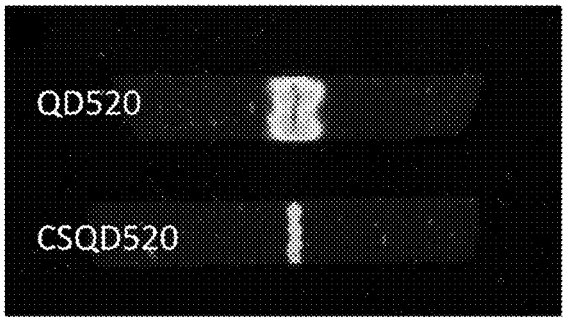
FIGS. 19A and 19B are images showing the interaction of CS-QD520 on a sensor substrate surface wherein both QD520 and CS-QD520 were applied on the sensor substrate surface and dried in the vacuum oven.
Figure 19B:
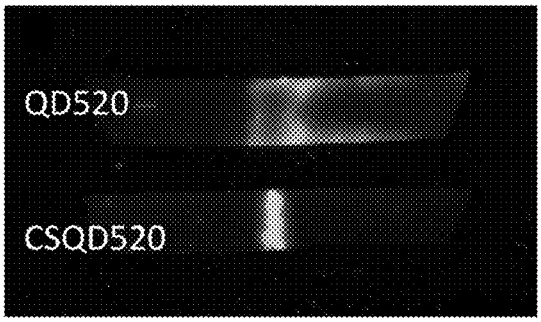

Chitosan was incorporated into CdTe QDs to facilitate its use on a paper-based well plate format. Chitosan is a biocompatible and biodegradable polymer, lending to its use in this example. Due to the fact that chitosan contains plenty of amino groups on the side chain, they are readily available for bioconjugation, exhibiting a positive charge at acidic to neutral pH (pKa of D-glucosamine unit=6.5-7.0). When CS-QD520 was applied on the glass microfiber filter containing silanol group, the chitosan-QD nanoparticle electrostatically adsorbed only on the top of the substrate, while QD520 thoroughly absorbed into the substrate. The retention capability of chitosan encapsulated QDs also was evaluated as shown in FIGS. 19A and 19B. The CS-QD520 permanently retained on the top of the substrate after flushing with 10 mL of PB buffer. The CS-QD520 remained a tight narrow band on the top of the GF/B, whereas the original QD520 leached off from the substrate. Having a low fluorescence background and loading volume capacity, the glass microfiber filter enabled the retention of CS-QD520 on its top surface. This improved the homogeneity of fluorescence signal, promoting its use on paper-based format.

The performance of the well plate was evaluated for PCL hydrophobicity. Two parameters were assessed, namely volume of liquid sample and retention time for liquid to be held in the openings. These two parameters related to the degree of contamination from opening to opening. Food coloring was used and represented as a liquid sample applied on the plate so that the visual inspection can be determined. With 5% PCL sprayed on the paper, the loading capacity of the liquid sample was 25 μL/opening. When the percentage of PCL was increased to 10%, the sample loading capacity raised up to 30 μL.

According to the fabrication design of the well plate as a stacking layer, the sample loading capacity of the paper-based well plate can be increased by inserting another layer in the middle for a larger volume. In one example, the loading capacity was increased up to 40 μL with a 4-layer paper-based plate design.

Example 3

Figure 20A:
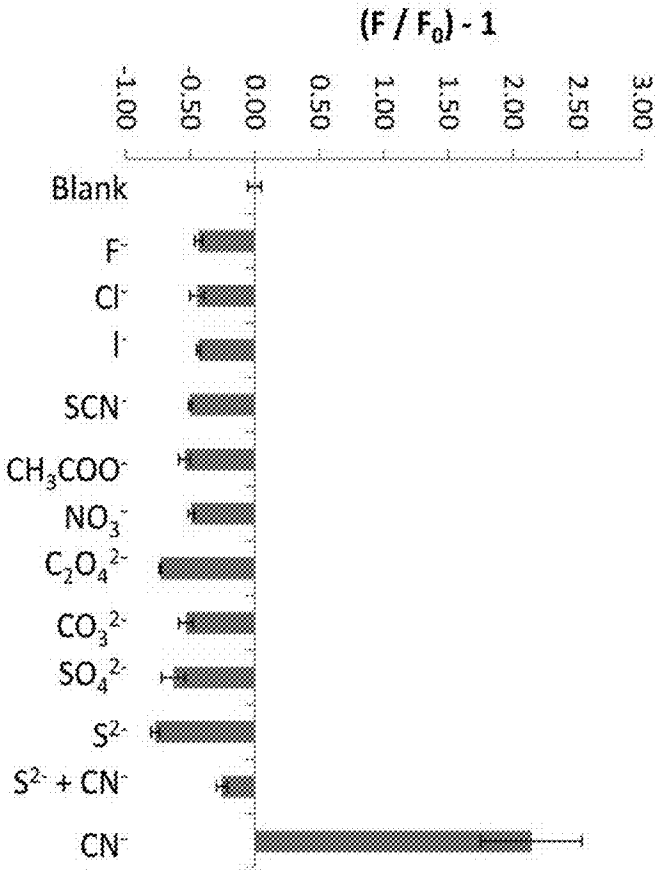
FIGS. 20A and 20B are graphs showing selectivity of a representative assay on paper-based well plates.
Figure 20B:
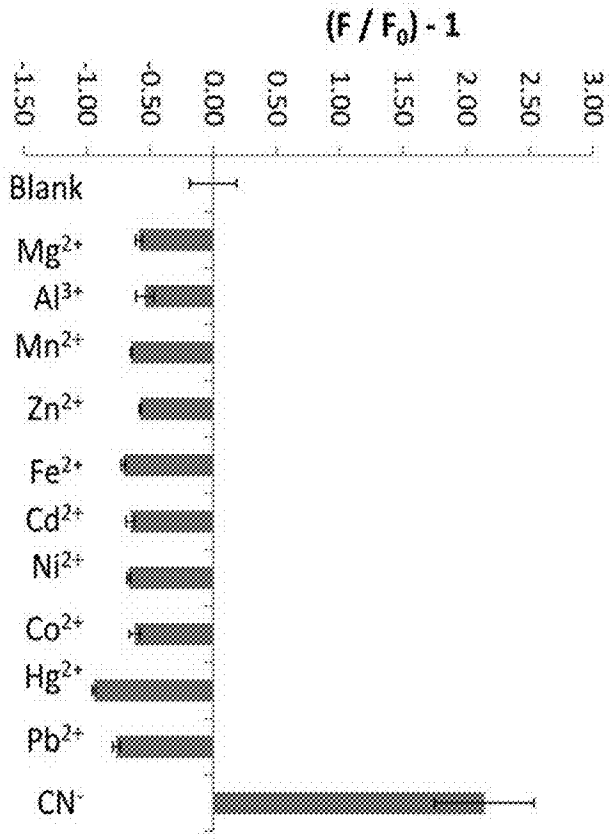

The selectivity of the assay on the paper-based well plate described above was evaluated by testing with several common anions and cations, including $F^-$, $I^-$, $SCN^-$, $CH_3COO^-$, $NO_3^-$, $C_2O_4^{2-}$, $CO_3^{2-}$, $SO_4^{2-}$, $S^{2-}$, $Mg^{2+}$, $Al^{3+}$, $Mn^{2+}$, $Zn^{2+}$, $Fe^{2+}$, $Cd^{2+}$, $Ni^{2+}$, $Co^{2+}$, $Hg^{2+}$, and $Pb^{2+}$ at a concentration of 1 mM. Their fluorescence signals were monitored and compared with the fluorescence obtained from cyanide at 100 μM. The results showed in FIG. 20A and FIG. 20B that all tested anions and cations did not generate increasing signal. Hence, the sensor probe was highly selective toward cyanide.

According to the EPA standard method 335.4, the detection method described here, was intended to determine free cyanide in a solution. If there is a presence of interferences in a solution, namely chlorine and sulfide, which can degrade cyanide into other forms, the sensor probe cannot be used in this case.

Figure 21A:
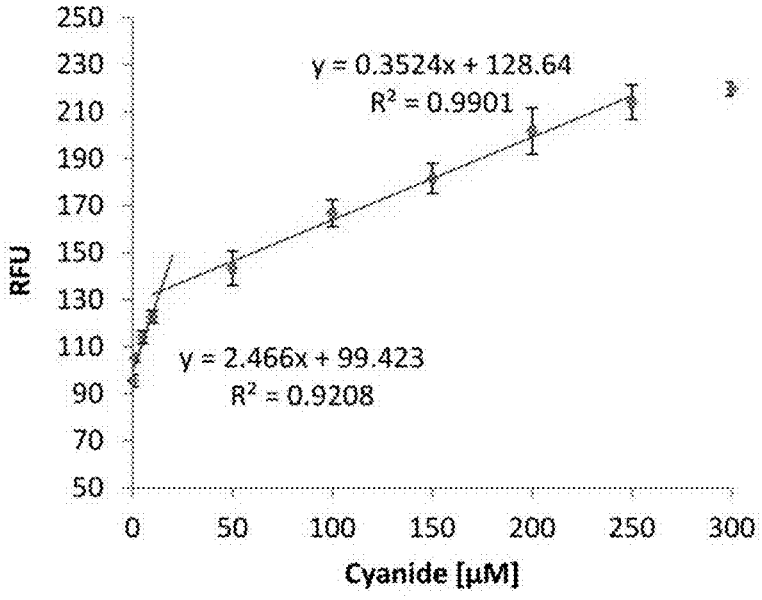
FIGS. 21A and 21B show the comparative sensitivity of the assay in a solution (FIG. 21A) and on a paper-based well plate (FIG. 21B) with the following conditions: CS-QD520 at 8.17 μM was quenched with 50 μL-$Cu^{2+}$ (100 mg/L) for 2 hours; wherein for the solution-based assay, 50 μL of sensor was mixed with 50 μL of cyanide standard.
Figure 21B:
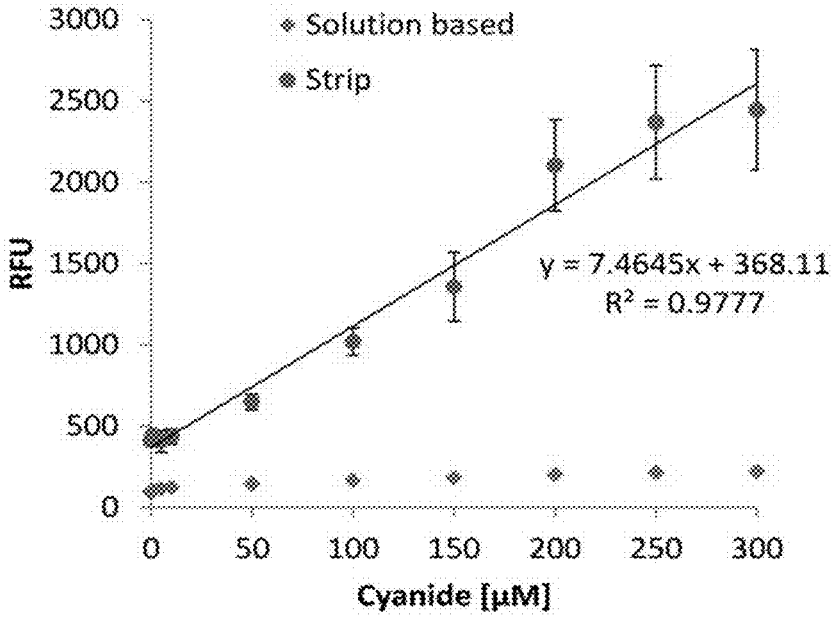

The highly selective assay of copper-modulated chitosan-QDs was transferred to the paper-based format presenting several advantages over a solution-based assay. One benefit was that paper-based well plates offered higher sensitivity than the solution based formats. One example (where results are shown in FIGS. 21A and 21B), illustrated that that a dried assay on a paper-based well plate has about 20 times higher sensitivity than the assay in a solution due to the high surface to volume ratio of GF/B used as a supporting material. QD sensors were pre-concentrated on the top surface of GF/B.

Figure 22A:
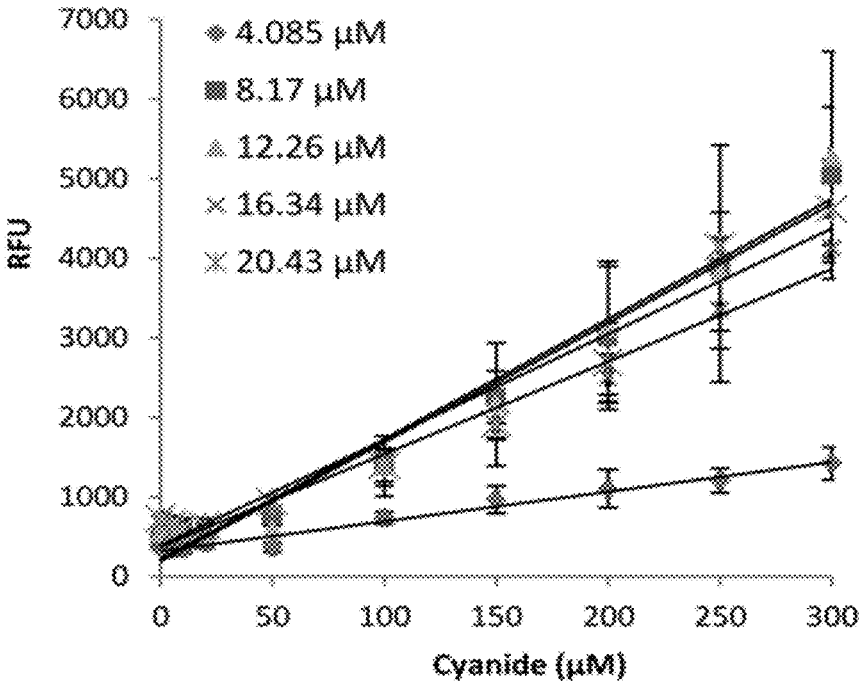
FIGS. 22A-22C are graphs showing optimization parameters for cyanide detection on paper-based well plates.
Figure 22B:
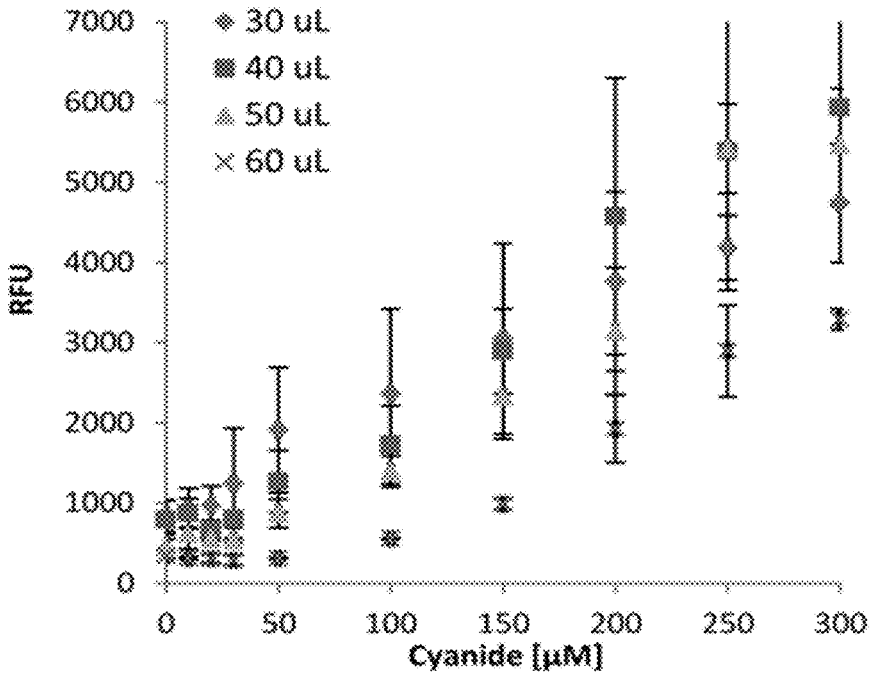
Figure 22C:
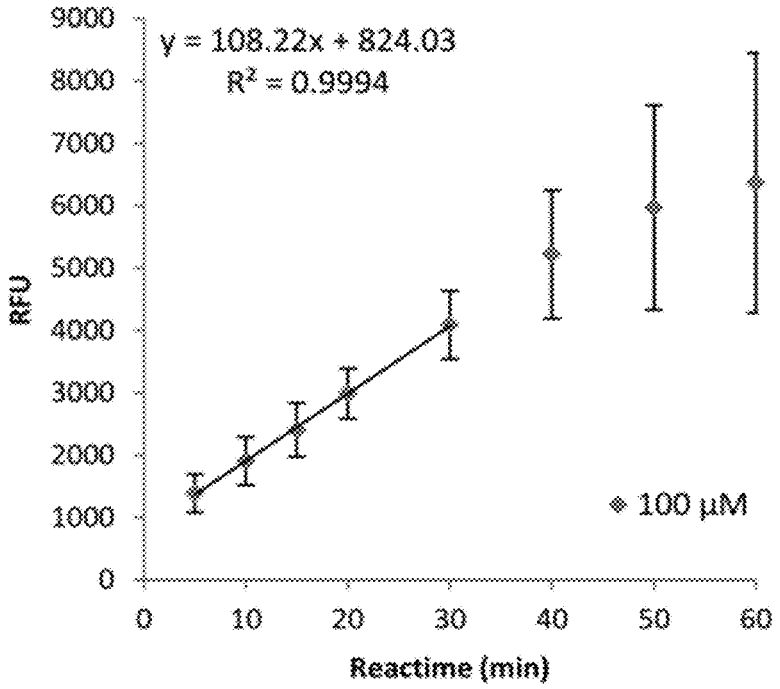

In order to maximize the sensitivity of the paper-based well plate cyanide detection, the assay chemistry was optimized, including probe concentration, amount of $Cu^{2+}$ for quenching, and reaction time. Firstly, CS-QD520 concentration was varied from 4.08-20.43 μM. The calibration graphs in FIG. 22A showed that the calibration slopes dramatically increased from 4.08 μM to 8.17 μM and after 8.17 μM, the slope did not significantly changed. The optimum sensor probe concentration was then chosen at 8.17 μM. Second, the amount of $Cu^{2+}$ to modulate the fluorescence signal played a crucial role for the sensitivity since the detection mechanism was based on the formation of $[Cu(CN)_x]^{1-x}$ species (see FIG. 22B). For example, if there is free $Cu^{2+}$ in the assay, it will first form a complex with the added cyanide and no fluorescence is generated. On the contrary, if there is less $Cu^{2+}$ in the assay, high fluorescence background will be obtained, which then deteriorate the detection limit. The optimum amount of $Cu^{2+}$ (100 mg/L) for QD quenching was 40 μL per 1 mL of 8.17 μM CS-QD520. Third, the reaction time for fluorescence recovery was monitored, shown in FIG. 22C. After the introduction of cyanide, fluorescence slowly regenerated owing to the releasing of free CS-QD520 from copper. The longer reaction time, the more sensitive the assay. However, there was a necessity for minimizing reaction time while maintaining high sensitivity. The optimum reaction time was chosen at 30 min because it gave higher sensitivity with low standard deviation.

Figure 23:
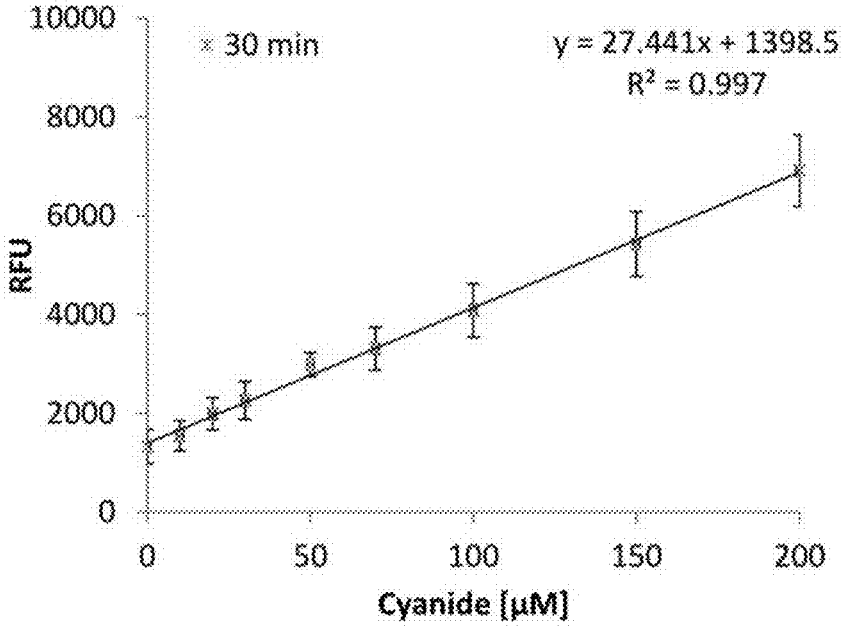
FIG. 23 is an endpoint calibration graph derived from paper-based well plates for cyanide detection wherein the following conditions were used: CS-QD520=8.17 μM, amount of $Cu^{2+}$ (100 mg/L)=40 μL/1 mL of 8.17 μM CS-QD520, reaction time=30 min.

A calibration curve for cyanide detection in water samples was established with the optimum conditions. The data for calibration curves was collected both within-day and between-days (4 days; n=12). A linear calibration plot in a range of 0-200 μM was generated from the entire data pool; $y=27.441x+1398$ ($R^2=0.997$) (FIG. 23).

Limit of detection (LOD) and limit of quantification (LOQ) were determined using the International Union of Pure and Applied Chemistry (IUPAC) definitions. LOD and LOQ were 11.6 μM (0.3 μg/mL) and 38.7 μM (1 μg/mL), respectively. The LOD presented here by disposable paper-based well plate was comparable to the commercially available, "Cyantesmo kit" (0.25-30 μg/mL) with quantitative results.

The real sample analysis was performed by using drinking water as a matrix. Drinking water was obtained from a local store; adjusted to pH above 12 with 50% NaOH and analyzed using the assay. It was found that there was no cyanide detected in the drinking water used. The accuracy and precision of the detection system were assessed by measuring recovery at three standardized cyanide concentration levels added to drinking water; low (50 μM), medium (100

μM), and high (200 μM) over the calibration curve (Table 1). At low cyanide concentration (50 μM), the % RSD was larger than that of high cyanide concentration (200 μM). The disposable paper-based well plate demonstrated high accuracy with acceptable recovery (the recovery levels recommended by the Association of Official Analytical Chemists (AOAC) International are in the range of 75-120% at the 1 ppm concentration level). The lower recovery of cyanide at 50 μM may result from the trace metal containing in the drinking water, which depleted the fortified cyanide standard.

| | Found | | | % Recovery | |
|---|---|---|---|---|---|
| Add (μm) | Value (μm) | SD | RSD | Value | SD |
| 50 | 37.64 | 5.33 | 14.16 | 75.28 | 10.66 |
| 100 | 82.72 | 8.75 | 10.57 | 82.72 | 8.75 |
| 200 | 198.25 | 12.44 | 6.27 | 99.13 | 6.22 |

Example 4

Figure 24:
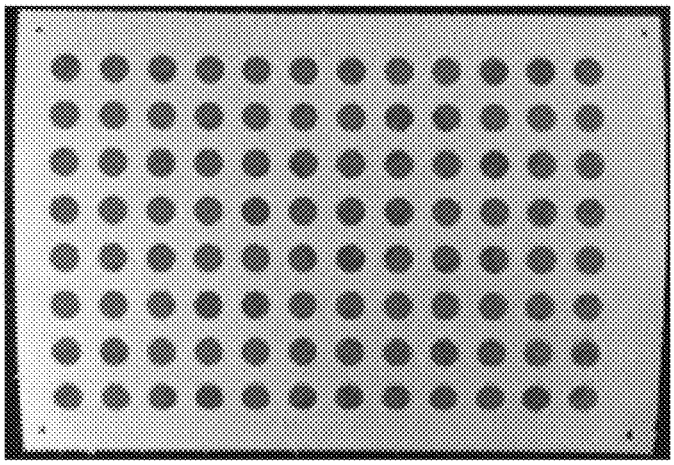
FIG. 24 is an image of a representative well plate device wherein the well plate device is made using aerosolized deposition of PCL wherein masking tape is used to cover the areas of desired hydrophilicity to thereby form wells on the substrate.
Figure 25A:
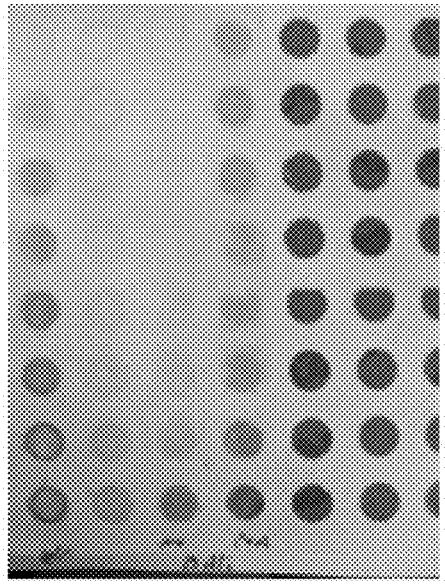
FIGS. 25A and 25B are images of a representative well plate device (FIG. 25A) and a corresponding calibration curve for glucose data obtained from using the device (FIG. 25B), wherein uric acid, glucose, and bilirubin (×2) assays (left to right) were conducted using the device.
Figure 25B:
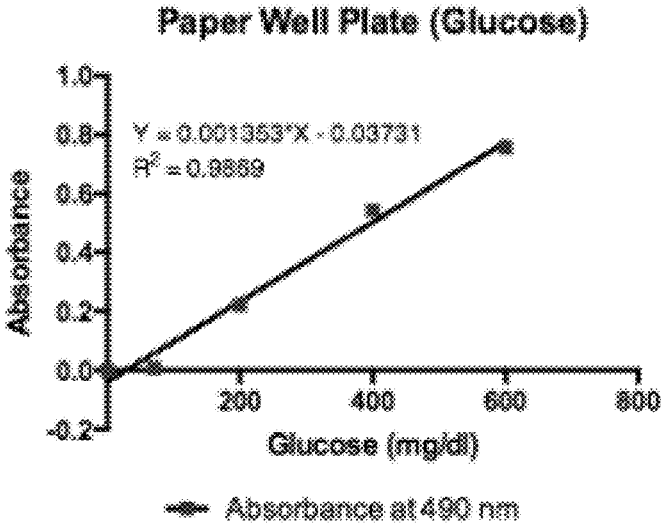

In this example, a paper-based well plate analytical device was fabricated by aerosolized deposition of a polymer solution (7.5% (w.v.) PCL in toluene) onto a masked substrate. Whatman no. 1 CHR filter paper was masked with Scotch Blue with Edgelock painters tape. A 96-well plate configuration was then designed in CAD software (Solidworks) and transferred to the masked substrate with a suitable method, such as a laser cutter or plotting cutter. The prepared substrate was then treated with aerosolized PCL via an airbrush rendering the unmasked material hydrophobic. The treated substrate was then dried under ambient conditions before the masking material was removed exposing the hydrophilic 96-well plate. A representative embodiment is illustrated in FIG. 24 and FIGS. 25A and 25B show the results obtained using the device of FIG. 24 in uric acid, glucose, and bilirubin (×2) assays.

Example 5

In this example, a paper-based well plate analytical device useful for fluorescence-based analytical techniques was prepared. The device was fabricated by aerosolized deposition of a polymer solution (7.5% (w/v) PCL (MW=37,000) in toluene) onto a masked substrate. Ahlstrom Grade 8613 black filter paper was masked with masking tape (namely, Scotch Blue with Edgelock painters tape). The desired design (e.g., 96 well plate or microfluidic architecture) was then designed in CAD software (Solidworks) and transferred to the masked substrate with a laser cutter. The prepared substrate was then treated with aerosolized PCL via an airbrush rendering the unmasked material hydrophobic. The treated substrate was then dried under ambient conditions before the masking material was removed exposing the hydrophilic 96-well plate. The dark color of the filter paper significantly reduced the background fluorescence associated with PCL and plain white filter paper.

Example 6

Figure 26A:
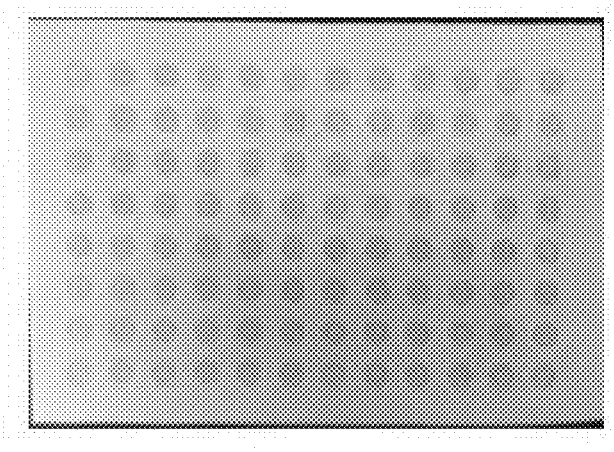
FIGS. 26A and 26B are photographic images of additional well plate devices formed by filling filter paper with PCL via soaking and wherein the openings are cut using a laser cutter or another method and multiple layers are laminated together.
Figure 26B:
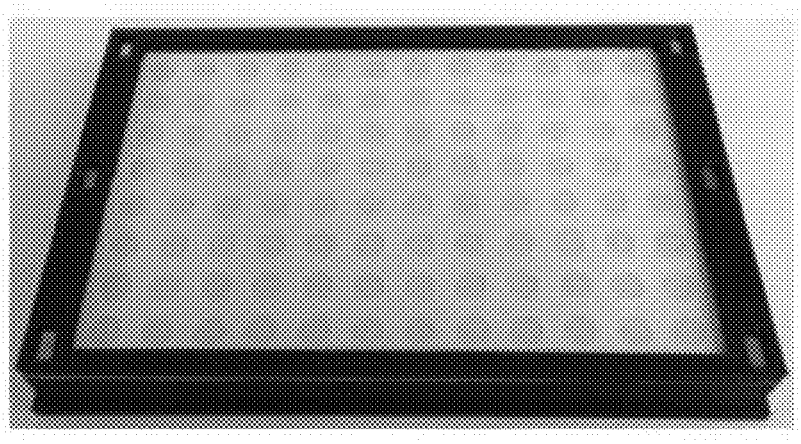
Figure 27A:
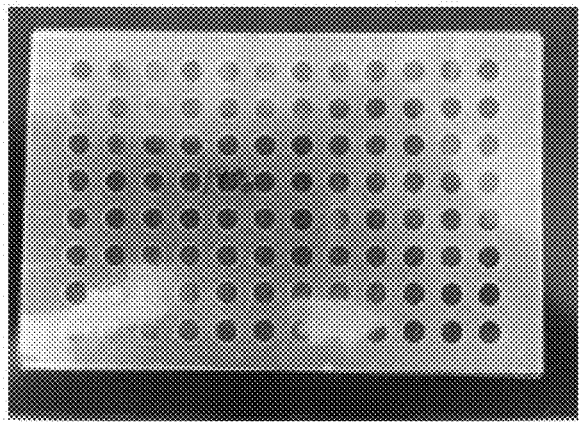
Figure 27B:
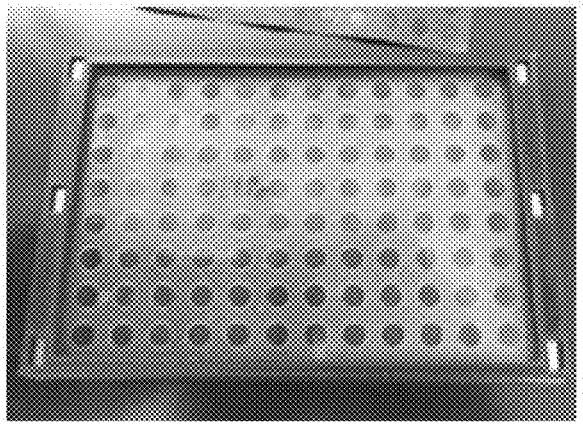
FIG. 27B is a top view of a constructed well plate device in a plate frame.
Figure 27C:
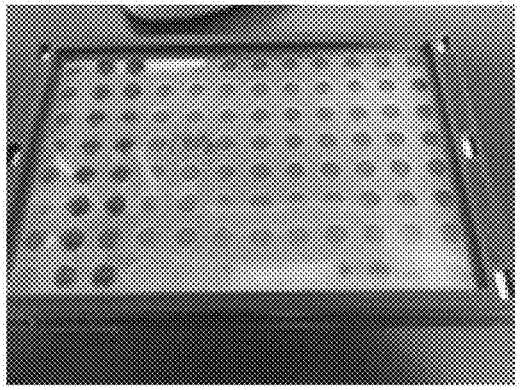
FIG. 27C is a photographic image of the device after colored fluids have been added to show the ability of the well plate to hold and separate the fluids.
Figure 27D:
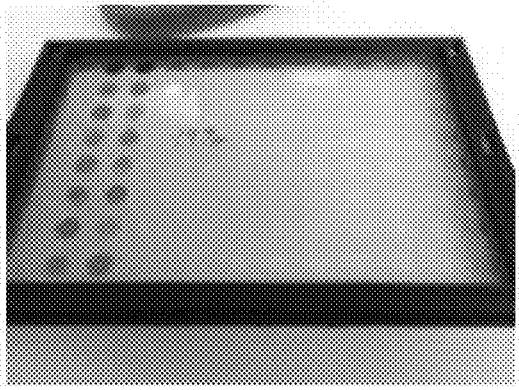
FIG. 27D is a photographic image of the device placed on white background.
Figure 27E:
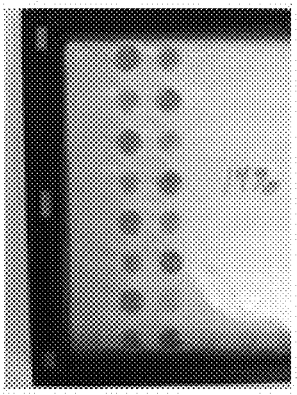

In this example, a low-volume paper-based well plate "dimple plate" was fabricated by saturating porous media with PCL, followed by cut and stack lamination. Whatman no 1 CHR filter paper was saturated with a solution of PCL (15% (w/v) (MW=80,000) in toluene and hung to dry under ambient conditions. The treated paper was hung to allow even evaporation from all sides of the substrate leading to an even distribution of polymer on all surfaces. Next, the well plate design (drawn in CAD software) was cut into the treated paper and the substrates (solid bottom and well plate top piece) were laminated at a temperature greater than 60° C. (using a Scotch TL901 thermal laminator on 5 mil setting ~120° C.). The plate is ready to use as a low volume well plate for colorimetric and UV-Vis based assays. This saturation method also can be used to construct devices made of substrates permeated with PCL, such as the well plate devices illustrated in FIGS. 26A and 26B.

Example 7

In this example, a low-volume paper-based well plate "dimple plate" for fluorescence-based analysis was fabricated by saturating porous media with PCL followed by cut and stack lamination. Ahlstrom Grade 8613 black filter paper was saturated with a solution of PCL (15% (w/v) (MW=80,000) in toluene and hung to dry under ambient conditions. The treated paper was hung to allow even evaporation from all sides of the substrate leading to an even distribution of polymer on all surfaces. Next, the well plate design (drawn in CAD software) was cut into the treated paper and the substrates (solid bottom and well plate top piece) were laminated at a temperature greater than 60° C. (using a Scotch TL901 thermal laminator on 5 mil setting ~120° C.). The dark color of the plate reduces background fluorescence by limiting reflection from the white surface of most filter papers.

Example 8

In this example, a low-volume polymer-based well plate was fabricated by applying an even layer of PCL on the surface of a polymer film followed by cut and stack lamination. PET sheets (3M high temperature copier transparency sheets) were coated with an even layer of PCL ((7.5% w/v) (MW=37,000) in toluene with an airbrush and allowed to dry under ambient conditions. Next, the well plate design (drawn in CAD software) was cut into the treated PET sheet and the substrates (solid bottom and well plate top piece) were laminated at a temperature greater than 60° C. (using a Scotch TL901 thermal laminator on 5 mil setting ~120° C.). The well plate is then ready to be used for colorimetric and UV-Vis assays in either top or bottom read devices.

Example 9

In this example, a low-volume polymer-based well plate alternative is fabricated by applying an even layer of laser jet toner on the surface of a polymer film, and then cut and stack lamination. PET sheets (3M high temperature copier transparency sheets) are coated with a single layer of black laser jet toner from an HP Laserjet color 500 M551 printer. Then, the well plate design (drawn in CAD software) is cut into the prepared PET sheet and the substrates (solid bottom and well plate top piece) are laminated with a Scotch TL901 thermal laminator on 5 mil setting (~120° C.). The well plate is then ready to be used for colorimetric and UV-Vis assays in either top or bottom read devices. In this embodiment, the toner can be used as an adhesive, but in other embodiments, a hydrophobic polymer component can be used as an adhesive. A representative embodiment of a low-volume well plate embodiment is shown in FIGS. 27A-27E.

Example 10

Paper-based hybrid microfluidic well plates combine features of paper-based well plates and low volume paper-based well plates. Hybrid microfluidic plates offer the ability to incorporate multiple materials such as filtration within the structure of a single plate. These devices are fabricated by saturation porous media such as Whatman no. 1 CHR with PCL (15% (w/v) MW=80,000 in toluene or other suitable solvent) and hung to dry under ambient conditions. Hanging allows even evaporation of the toluene leading to an even distribution of polymer throughout the media and on the surface. Microfluidic architecture is then cut into the material with a laser cutter (or cutting plotter). Porous membrane material (matching the design cut into the PCL treated paper, thus providing a sensor layer) is then cut using the same method. The final device is assembled by lamination of the substrates, including the porous membrane, at a temperature greater than 60° C. A representative embodiment is illustrated in FIGS. 6, 7, and 8.

Example 11

A reusable frame for use with all well plate based devices was fabricated via 3D printing. The frame was divided into two components, a second piece matching the dimensions of standard well plates, and a first piece for clamping well plate based devices. Both of the fabricated pieces were first designed in Solidworks (CAD software) and then printed with an Ultimaker 2 3D printer using polylactic acid (PLA), a biodegradable material. Neodymium magnets were then embedded in both portions of the frame (6 per section) allowing strong clamping and self-alignment of the frame pieces around well plate based devices. An alignment device was also fabricated in the same manner. The alignment device is composed of a rectangular frame that fits around the exterior of the second well plate frame ensuring reproducible alignment of the well plate based devices. Proper alignment facilitates use with current technologies, such as plate readers and liquid handling instrumentation that are calibrated for standard 96 well plates.

Example 12

Figure 28:
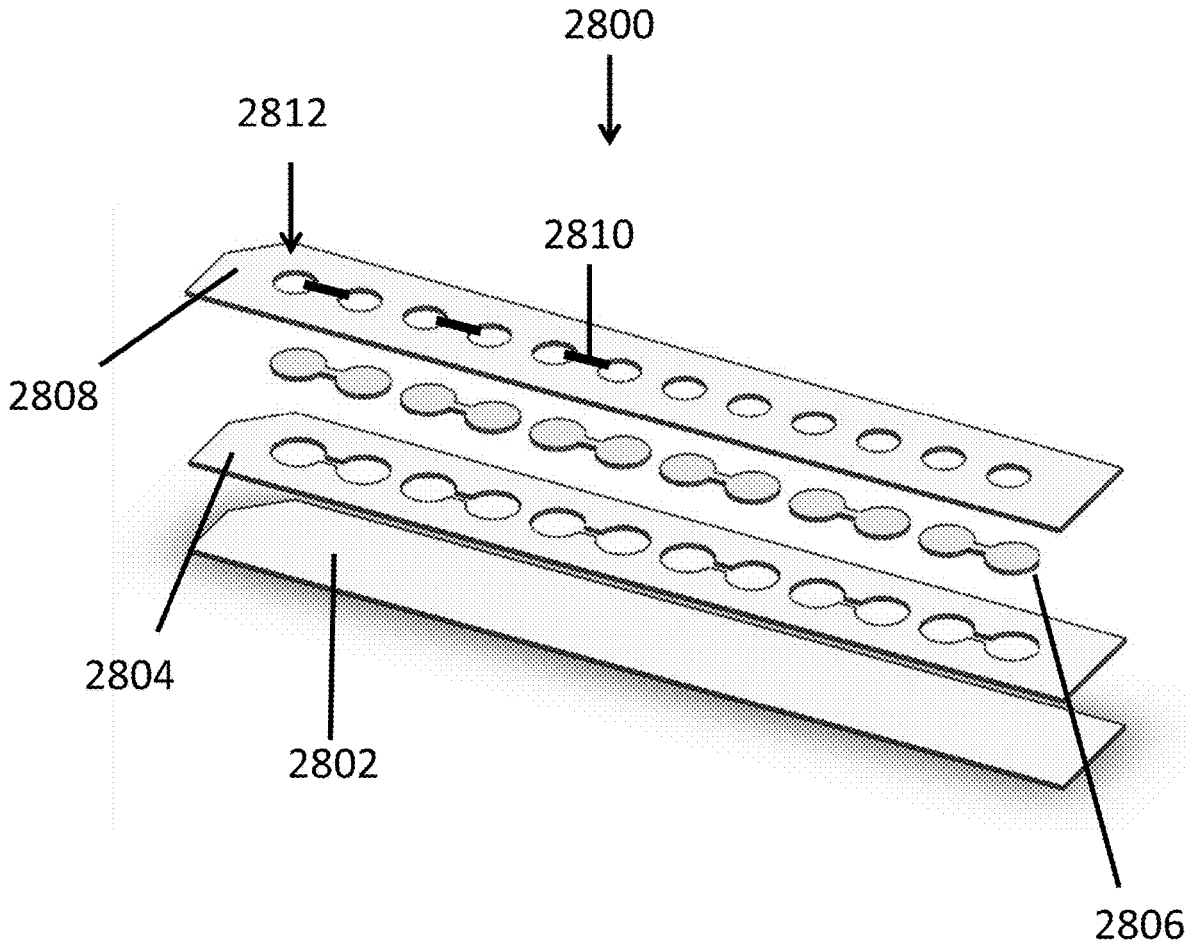
FIG. 28 is an illustration of a multilayer device which includes a single-use valve system that isolates or connects adjacent wells.
Figure 29A:
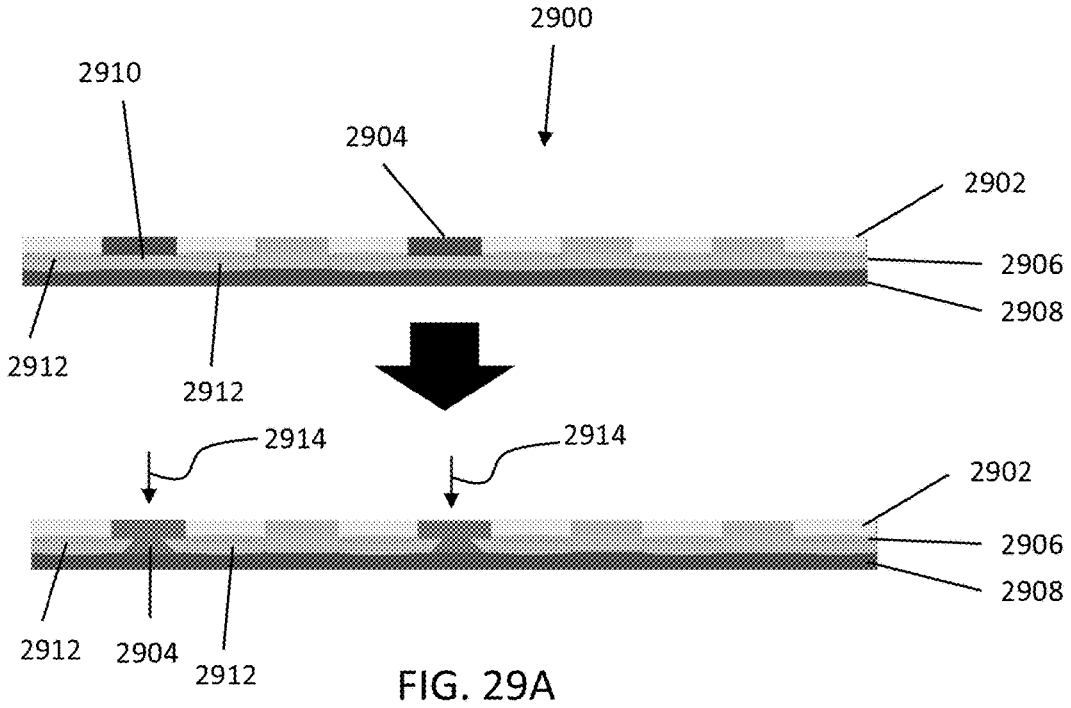
FIGS. 29A and 29B are cross-sectional illustrations of valve embodiments describing their operation (normally open and normally closed valve actuation mechanisms, respectively.)
Figure 29B:
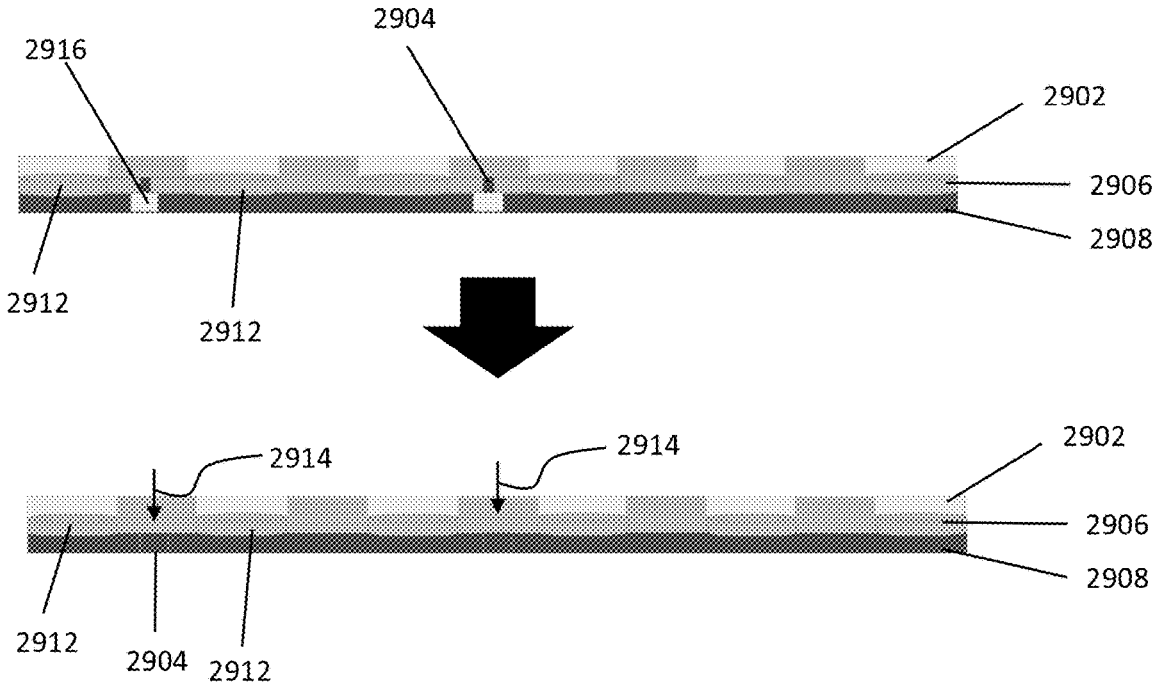

In this example, a valve-containing embodiment is described. As illustrated in FIG. 28, valve-containing device 2800 comprises four layers, including a bottom layer 2802, an intermediate substrate 2804, sensor substrates 2806, and a top substrate 2808. Top substrate 2808 comprises channels 2810, which comprise a polymer capable of being melted such that it serves as valve controlling flow between openings 2812 of the top substrate. By irradiating channels 2810 of the top substrate 2808, the polymer in the channels can be melted and flow can occur through the otherwise blocked channel. An exemplary schematic showing how the valves work, such as the valves illustrated in FIG. 28, are provided by FIGS. 29A and 29B. As illustrated in FIG. 29A, which is a cross-sectional view of a device 2900, regions of a top layer 2902 can be filled or saturated with a low melting material 2904. The low melting material 2904 can be positioned above sensor substrate layer 2906, which is adjacent to a bottom substrate 2908, and comprises hydrophilic connections 2910 between each well region 2912 of the sensor substrate. Upon applying localized heat (represented by arrow 2914), the low melting material 2904 is melted and can move into the hydrophilic connections 2910 so as to block flow between the well regions 2912. In another embodiment illustrated in FIG. 29B, a sump component 2916 can be used in bottom substrate 2908 so as to provide a region into which a low melting component 2904, which is positioned between well regions 2912, can be received after melting. By doing so, the previously blocked hydrophilic connection 2910 is opened such that flow between well regions 2912 can occur.

Example 13

Figure 30:
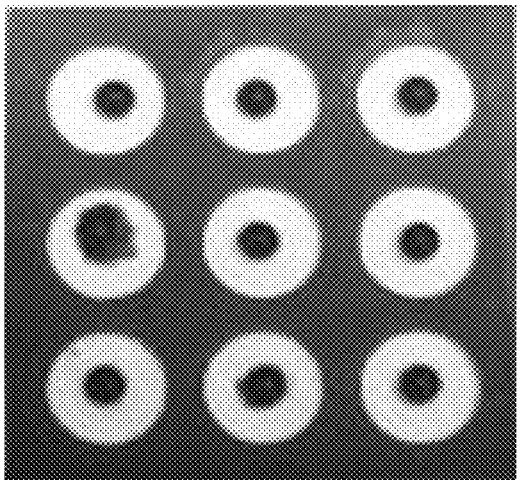
FIG. 30 is an image of a representative device that comprises an intermediate substrate having wells passivated with bovine serum albumin so as to prevent interaction between areas of the well and the deposited blue dye.

FIG. 30 is an image of a device having wells that have been modified with bovine serum albumin. As shown by FIG. 30, there is limited interaction between the wells of the substrate and an aqueous blue dye deposited within the well.

Example 14

Figure 31:
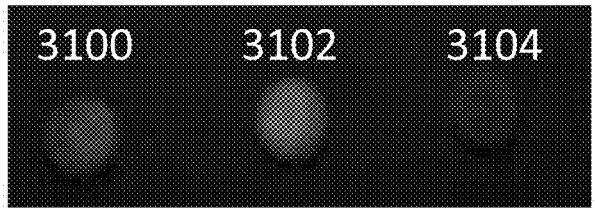
FIG. 31 is an image obtained from fluorescence image of a device embodiment wherein one well has been passivated with bovine serum albumin (left), one well has not been passivated (middle); and one well has been treated with trimethyl chlorosilane (right).

In this example, a surface-passivated intermediate substrate (shown by FIG. 31) is configured to comprise three different wells: (a) a first well 3100 that has been surface-passivated with bovine serum albumin; (b) a second well 3102 that was not surface-passivated; and (c) a third well 3104 treated with a TMCS coupling reagent. The device was exposed to an assay component, EvaGreen dye, which is used for DNA quantification. As shown by FIG. 31, the activity of the EvaGreen dye immobilized in the first and third wells comprising the surface-passivating reagent and the TMCS, respectively, was preserved, whereas the second well, which did not comprise a surface passivating agent, did not preserve the dye's activity as evidenced by visualization of the dye (suggesting the denaturing of the dye due to the surface deposition).

VII. Overview of Several Embodiments

Described herein are embodiments of polymer-based analytical devices, comprising: a substrate comprising a coating of a hydrophobic polymer component wherein the coating of the hydrophobic polymer is configured to define outer perimeters of wells on or openings in the substrate and wherein the hydrophobic polymer component has a structure satisfying Formula I Formula I

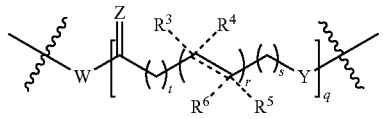

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

In any or all of the above embodiments, the substrate is a paper substrate.

In any or all of the above embodiments, the substrate is a black paper substrate.

In any or all of the above embodiments, the substrate further comprises a fluidic channel formed in the coating of the hydrophobic polymer component, wherein the fluidic channel fluidly connects two or more wells or openings of the substrate.

In any or all of the above embodiments, the substrate is treated with a surface passivating agent. In some embodiments, the passivating agent is a blocking agent selected from bovine serum albumin or milk protein; or a silylating agent.

In any or all of the above embodiments, the substrate comprising a coating of a hydrophobic polymer component can be a top substrate and the polymer-based analytical device can further comprise: an intermediate substrate coupled to the bottom substrate, the intermediate substrate comprising a coating of a hydrophobic polymer component that defines outer perimeters of wells on or openings in the intermediate substrate and having a pattern matching a pattern of the wells or openings of the intermediate substrate; a sensor substrate coupled to the intermediate substrate, the sensor substrate comprising a signaling moiety or a sample; and a bottom substrate coated with a hydrophobic polymer; wherein the hydrophobic polymer component of the top substrate, the intermediate substrate, and the bottom substrate independently has a structure satisfying Formula I:

Formula I

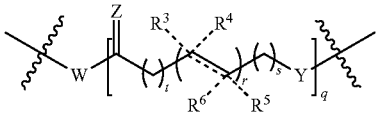

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

In yet additional embodiments, the polymer-based analytical device comprises a bottom substrate comprising a coating of a hydrophobic polymer component; an intermediate substrate coupled to the bottom substrate, the intermediate substrate comprising a coating of a hydrophobic polymer component that defines outer perimeters of wells on or openings in the intermediate substrate; a sensor substrate coupled to the intermediate substrate, the sensor substrate comprising a signaling moiety or a sample; and a top substrate coupled to the sensor substrate, the top substrate comprising a coating of a hydrophobic polymer component that defines outer perimeters of wells or openings having a pattern matching a pattern of the wells or openings of the intermediate substrate; wherein the hydrophobic polymer component has a structure satisfying Formula I:

Formula I

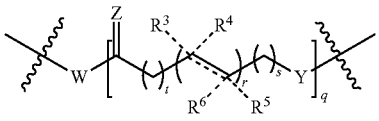

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

In any or all of the above embodiments, the bottom substrate, the intermediate substrate and the top substrate are made of a cellulosic material.

In any or all of the above embodiments, the sensor substrate comprises a signaling moiety capable of producing a fluorescent or colorimetric signal.

In any or all of the above embodiments, the hydrophobic polymer component is polycaprolactone, polycaprolactone diol, polycaprolactone triol, polycaprolactone-block-polytetrahydrofuan-block polycaprolactone, poly(ethylene oxide)-block-polycaprolactone, poly(ethylene glycol)-block-poly(e-caprolactone) methyl ether, or any combination thereof.

In any or all of the above embodiments, the bottom substrate, the intermediate substrate and the top substrate are black paper substrates.

In any or all of the above embodiments, the sensor layer comprises a plurality of individual sensor substrates configured to have dimensions matching dimension of the wells or openings of the intermediate substrate.

In any or all of the above embodiments, the intermediate substrate further comprises a fluidic channel formed in the coating of the hydrophobic polymer component, wherein the fluidic channel fluidly connects two or more wells or openings of the intermediate substrate.

Also disclosed herein are embodiments of methods for making polymer-based analytical devices, comprising: masking a substrate made of a polymeric material with a masking material to form a masked substrate; patterning the masked substrate by cutting a pre-determined pattern into the masking material thereby providing hydrophilic unmasked areas of the masked substrate and masked areas of the masked substrate; coating the hydrophilic unmasked areas of the substrate with a hydrophobic polymer layer thereby converting the hydrophilic unmasked areas of the masked substrate to hydrophobic unmasked areas; and removing any remaining masking material from the masked substrate to expose one or more wells or openings, each of which has an outer perimeter defined by the hydrophobic polymer layer of the substrate and wherein the wells or openings are configured in the pre-determined pattern.

In any or all of the above embodiments, the method can further comprise combining the substrate with one or more additional hydrophobic polymer-coated substrates.

In any or all of the above embodiments, the method can further comprise laminating the substrate and the one or more additional substrates together such that the hydrophobic polymer layer of the one or more substrates bonds the substrate and the one or more additional substrates together.

In additional embodiments, the methods can comprise making a substrate-based analytical device. Such methods can comprise exposing a polymeric substrate to a solution of a hydrophobic polymer component to form a layer of the hydrophobic polymer component that fully covers the polymeric substrate thereby forming a fully-coated polymeric substrate; patterning the fully-coated polymeric substrate to comprise a plurality of wells or openings thereby forming a patterned polymeric substrate, wherein each well or opening of the plurality of wells or openings has an outer perimeter defined by the hydrophobic polymer; exposing the patterned polymeric substrate to $O_2$ to render the hydrophobic polymer located in the wells or openings; and coupling the patterned polymeric substrate with a hydrophobic polymer-coated bottom substrate.

In any or all of the above embodiments, coupling comprises laminating the polymer-coated bottom substrate and the patterned polymeric substrate.

In any or all of the above embodiments, the polymeric substrate is a paper substrate or a transparent polymer-based substrate.

In some embodiments, the method of making device embodiments described herein can comprise making the intermediate substrate and the top substrate using a screen printing technique whereby the hydrophobic polymer component is screen printed onto the intermediate substrate and the top substrate.

Also disclosed herein are embodiments of a plate frame, comprising: a first component made of a biodegradable polymeric material and having an outer perimeter section; a second component made of a biodegradable polymeric material and having an outer perimeter section configured to align with the outer perimeter section of the first component; one or more magnets positioned within the outer perimeter section of the second component; and one or more magnets positioned within the outer perimeter section of the first component, which magnets of the first component are positioned to align with the magnets of the second component and secure the first component to the second component in a predetermined alignment by magnetic attraction; wherein when the first component and the second component are associated together, they define a chamber that is configured to receive the polymer-based analytical device of any or all of the above embodiments between the second component and the first component.

In view of the many possible embodiments to which the principles of the present disclosure may be applied, it should be recognized that the illustrated embodiments are only examples and should not be taken as limiting the scope of the present disclosure. Rather, the scope is defined by the following claims. We therefore claim as our invention all that comes within the scope and spirit of these claims.

We claim:

1. A polymer-based analytical device, comprising:

a top substrate comprising a coating of a hydrophobic polymer component wherein the coating of the hydrophobic polymer is configured to define outer perimeters of wells on or openings in the top substrate;

a bottom substrate coated with a hydrophobic polymer component;

an intermediate substrate coupled to the bottom substrate, the intermediate substrate comprising a coating of a hydrophobic polymer component that defines outer perimeters of wells on or openings in the intermediate substrate and having a pattern matching a pattern of the wells or openings of the top substrate; and a plurality of sensor substrates coupled to the intermediate substrate, wherein one or more of the sensor substrates of the plurality comprises a signaling moiety capable of producing a fluorescent or colorimetric signal; and wherein the top substrate, the bottom substrate, the sensor substrate, and/or the intermediate substrate independently comprises a microfiber material, a cellulosic material, a woven material, or a natural material, and wherein the hydrophobic polymer components of the top substrate, the intermediate substrate, and the bottom substrate each independently has a structure satisfying Formula I Formula I

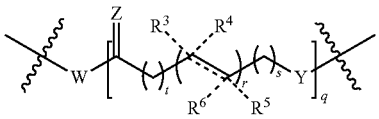

wherein Z, Y, and W independently can be O, S, NH, or $NR^2$, where $R^2$ is hydrogen, aliphatic, aryl, or heteroaryl; each of $R^3$, $R^4$, $R^5$ and $R^6$ (if present) independently are hydrogen, aliphatic, aryl, heteroaryl, or a heteroatom-containing moiety; r is an integer selected from 1 to 4; s and t independently are integers selected from 0 to 4; and q is an integer selected from 1 to 1000.

2. The polymer-based analytical device of claim 1, wherein each of the top substrate, the bottom substrate, and the intermediate substrate is a porous substrate.

3. The polymer-based analytical device of claim 1, wherein the top substrate, the bottom substrate, and/or the intermediate substrate comprises a black paper substrate or a glass microfiber substrate.

4. The polymer-based analytical device of claim 1, wherein the top substrate further comprises a fluidic channel formed in the coating of the hydrophobic polymer component, wherein the fluidic channel fluidly connects two or more of the wells or openings of the top substrate.

5. The polymer-based analytical device of claim 1, wherein the top substrate and/or the intermediate substrate is treated with a surface passivating agent.

6. The polymer-based analytical device of claim 5, wherein the passivating agent is a blocking agent selected from bovine serum albumin or milk protein; or is a silylating agent.

7. The polymer-based analytical device of claim 1, wherein the hydrophobic polymer components of the top substrate, the intermediate substrate, and the bottom substrate each independently is one or more of polycaprolactone, polycaprolactone diol, polycaprolactone triol, polycaprolactone-block-polytetrahydrofuran-block polycaprolactone, poly(ethylene oxide)-block-polycaprolactone, poly(ethylene glycol)-block-poly(e-caprolactone) methyl ether, or any combination thereof.

8. The polymer-based analytical device of claim 1, wherein the bottom substrate, the intermediate substrate, and the top substrate are made of the cellulosic material.

9. The polymer-based analytical device of claim 1, wherein the bottom substrate, the intermediate substrate, and the top substrate are black paper substrates.

10. The polymer-based analytical device of claim 1, wherein the plurality of sensor substrates are configured to have dimensions matching dimension of the wells or openings of the intermediate substrate.

11. The polymer-based analytical device of claim 1, wherein the intermediate substrate further comprises one or more fluidic channels formed in the coating of the hydrophobic polymer component, wherein each of the fluidic channels fluidly connects two or more of the wells or openings of the intermediate substrate.

12. The polymer-based analytical device of claim 11, further comprising one or more hydrophilic connectors positioned within the fluidic channels of the intermediate substrate, wherein each of the hydrophilic connectors connects two or more of the plurality of sensor substrates.

13. The polymer-based analytical device of claim 12, wherein the top substrate covers the one or more fluidic channels of the intermediate substrate and the one or more hydrophilic connectors.

* * * * *